US012409393B2

(12) United States Patent
Qi et al.

(10) Patent No.: US 12,409,393 B2
(45) Date of Patent: Sep. 9, 2025

(54) INTEGRALLY-FORMED FINGER MANIPULATION SKILL TOY

(71) Applicants: Haihui Qi, Victoria (CA); Matthew Bryan Hiebert, Victoria (CA)

(72) Inventors: Haihui Qi, Victoria (CA); Matthew Bryan Hiebert, Victoria (CA)

( * ) Notice: Subject to any disclaimer, the term of this patent is extended or adjusted under 35 U.S.C. 154(b) by 314 days.

(21) Appl. No.: 16/102,699

(22) Filed: Aug. 13, 2018

(65) Prior Publication Data

US 2019/0111356 A1 Apr. 18, 2019

Related U.S. Application Data

(63) Continuation-in-part of application No. 29/612,015, filed on Jul. 27, 2017, now abandoned.

(60) Provisional application No. 62/618,763, filed on Jan. 18, 2018.

(51) Int. Cl.
*A63H 33/00* (2006.01)
*A63F 7/38* (2006.01)

(52) U.S. Cl.
CPC ..... *A63H 33/00* (2013.01); *A63F 7/382* (2013.01)

(58) Field of Classification Search
CPC ..... A63H 33/00; A63F 7/382
USPC ..... 446/26
See application file for complete search history.

(56) References Cited

U.S. PATENT DOCUMENTS 1,412,691 A * 4/1922 Lincoln ..... A63B 23/16 482/49
3,705,579 A * 12/1972 Morini ..... A61H 15/00 601/121
D248,420 S * 7/1978 Berman ..... D28/8.1
4,153,248 A * 5/1979 Holmes ..... A63B 37/10 473/595
D264,625 S * 5/1982 Shiu ..... D21/684
4,785,800 A * 11/1988 Stilson ..... A61H 15/00 601/121
4,984,784 A * 1/1991 Bailey ..... A63B 23/16 482/44
D340,487 S * 10/1993 Traub ..... D21/712
7,189,210 B1 * 3/2007 Hillman ..... A61H 15/00 601/27

* cited by examiner

*Primary Examiner* — Joseph B Baldori
(74) *Attorney, Agent, or Firm* — Integral Patent; Laurence J. Shaw

(57) ABSTRACT

An integrally-formed finger manipulation skill toy having an elongated central shaft and a bell at each end of the shaft, the bells having a width greater than that of the shaft. The toy has cylindrical symmetry about its longitudinal axis and mirror symmetry about a mirror plane through its midpoint to which the longitudinal axis is a normal vector. The contour when viewed in profile along an axis in the mirror plane and through the midpoint has concave regions in the center and convex regions at the ends.

9 Claims, 32 Drawing Sheets

INTEGRALLY-FORMED FINGER MANIPULATION SKILL TOY

RELATED APPLICATIONS

The present application is based on and claims the priority of design patent application Ser. No. 29/612,015, filed on Jul. 27, 2017, by Haihui QI and Matthew Bryan HIEBERT, entitled "Fidget toy," and is based on and claims the priority of provisional patent application Ser. No. 62/618,763, filed on Jan. 18, 2018, by Haihui QI and Matthew Bryan HIEBERT, entitled "Modular fidget toy."

FIELD OF THE INVENTION

The present invention relates to skill toys, more particularly to skill toys operated through finger manipulations, and still more particularly to integrally-formed skill toys operated through finger manipulations.

BACKGROUND OF THE INVENTION

One type of integrally-formed object used for finger manipulations is a coin used for rolling over the fingers of the operator. This is known as coin rolling and it is commonly performed by magicians who do tricks involving coins. An exemplary coin rolling move where the coin (110) is rolled over the back of the middle finger (103) of the operator is shown in the time sequence of FIGS. 1A, 1B, and 1C. Tutorials can be found in magic books, and demonstrations and tutorials can be found in online posted videos. Being coins, their shape is simply a circular disk, i.e., a thin cylindrical section, which possibly has a circumferential ridge. Generally, the coins used for this purpose are roughly US half dollar size so that, as shown in FIGS. 1A-1C, the rolling of the coin (110) over a phalanx (103) results in a 180 rotation of the coin (110). Although FIGS. 1A-1C show the rolling of the coin (110) over the back of the middle finger (103), the coin (110) may be similarly rolled over the back of other fingers (100) or the front of any of the fingers (100). (In the present specification the fingers (101), (102), (103), (104) and (105) are referred to collectively or generically with reference numeral "100".) It should be noted that performing this basic maneuver with a coin (110) requires considerable precision of movement of the fingers (100). Furthermore, it should be noted that although FIGS. 1A-1C show the rolling of the coin (110) over the back of the proximal phalanx (i.e., the phalanx nearest the palm) of the middle finger (103), the coin (110) may be rolled over the back or front of non-proximal phalanxes of the fingers (100). However, rolling the coin (110) over non-proximal phalanxes is more difficult because there are usually gaps between the non-proximal phalanxes through which the coin (110) may slip.

Another popular integrally-formed object used for finger manipulations is a pen or pencil which is spun around the fingers of the operator. This is commonly known as pen spinning. An exemplary pen spinning move where the pen (210) is spun over the back of the middle finger (103) of the operator is shown in the time sequence of FIGS. 2A through 2F. Demonstrations and tutorials of this maneuver and others can be found in online posted videos. Being pens and pencils, their shape and size is simply that of pens and pencils, i.e., they are roughly cylindrical with a length of between 14 and 17 cm, and a diameter of between 0.8 and 1.2 cm.

Another integrally-formed object which may be used for finger manipulations is a ball. An exemplary move where a ball (310) is rolled over the back of the index finger (103) of the operator is shown in the time sequence of FIGS. 3A, 3B and 3C. Although FIGS. 3A-3C show the rolling of the ball (310) over the back of the middle finger (103), the ball (310) may be similarly rolled over the back of other fingers (100) or the front of any of the fingers (100). It should be noted that FIGS. 3A-3C show the rolling of the ball (310) over the back of a non-proximal phalanx of the middle finger (103). The diameter of the ball (310) is too large to allow the ball (310) to be rolled over the back or front of the proximal phalanxes of the fingers (100). It should be noted that because of the spherical shape of the ball (310), performing this maneuver require considerable precision of movement of the fingers (100).

It is to be noted that these integrally-formed finger manipulations skill toys are commonly found objects and/or shapes, and the shapes of these integrally-formed finger manipulation skill toys are therefore not optimized to facilitate maneuvers or designed to allow new types of finger manipulation maneuvers to be performed.

It is therefore an object of the present invention to provide an integrally-formed finger manipulations skill toy which facilitates the performance of finger manipulation maneuvers.

More particularly it is an object of the present invention to provide an integrally-formed finger manipulations skill toy with a shape and size which facilitates the performance of finger manipulation maneuvers.

It is another object of the present invention to provide a finger manipulations skill toy which allows for the performance of new finger manipulation maneuvers.

It is another object of the present invention to provide a finger manipulations skill toy which allows for the performance of new types or genres of finger manipulation maneuvers.

More particularly it is an object of the present invention to provide a finger manipulations skill toy with a shape and size which allows for the performance of new finger manipulation maneuvers or new types or genres of finger manipulation maneuvers.

It is another object of the present invention to provide a finger manipulations skill toy with a profile contour which provides an amplification between the orientation of the fingers and the orientation of the toy.

It is another object of the present invention to provide a finger manipulations skill toy which, for a given length of the toy, provides an enhanced moment of inertia to facilitate maneuvers.

It is another object of the present invention to provide a finger manipulations skill toy with a profile contour which facilitates centering of the toy between the fingers.

Additional objects and advantages of the invention will be set forth in the descriptions which follow, and will be obvious from the descriptions or may be learned by practice of the invention. The objects and advantages of the invention may be realized and obtained by means of the instrumentalities and combinations particularly pointed out in the claims.

SUMMARY OF THE INVENTION

A finger manipulations skill toy having an elongated connecting shaft, a first bell at one end of the connecting shaft, and a second bell at the other end of the connecting shaft. The widths of the bells are greater than the width of the midpoint of the connecting shaft. The exteriors of the connecting shaft and the two bells form an exterior surface which has cylindrical symmetry about the longitudinal axis of the connecting shaft. The exterior surface also has mirror symmetry about a plane through the midpoint of the connecting shaft.

BRIEF DESCRIPTION OF THE DRAWINGS

The accompanying figures, which are incorporated in and form a part of this specification, illustrate embodiments of the invention and, together with the description given above and the detailed description of the preferred embodiments given below, serve to explain the principles of the invention.

DETAILED DESCRIPTION OF THE PREFERRED EMBODIMENTS

In the present specification the term integrally-formed toy means a toy that has no moving parts relative to itself in the course of play. An integrally-formed object may be made of a composite of materials, or carved, molded, or otherwise formed from a single material. It should be noted that a toy which is modular and may be disassembled or reconfigured can be considered integrally-formed if during play there are no moving parts relative to itself.

Figure 4A:
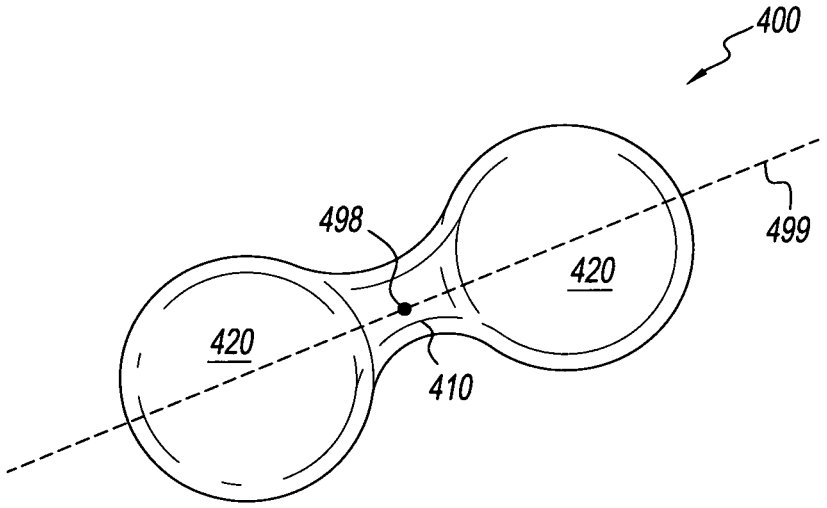
FIG. 4A shows a perspective view and FIG. 4B shows a side plan view of the skill toy of the present invention.
Figure 4B:
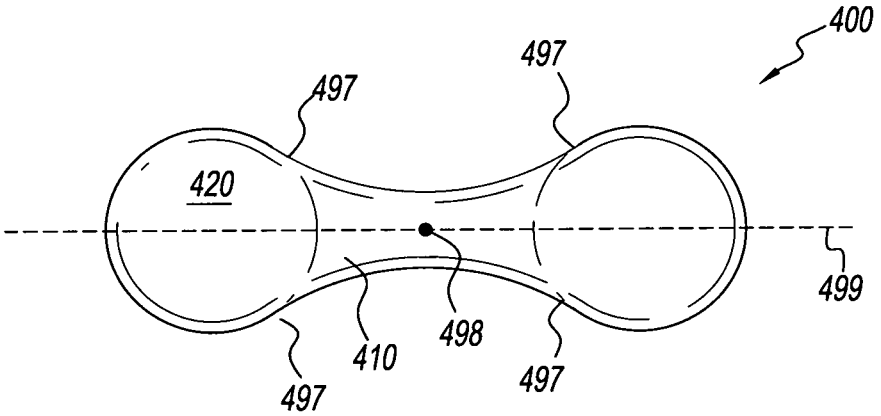

A preferred embodiment of the skill toy (400) of the present invention is shown in perspective in FIG. 4A and in a side plan view in FIG. 4B. The skill toy (400) has an elongated central shaft (410), a first bell (420) at a first end of the shaft (410), and a second bell (420) at a second end of the shaft (410). The bells (420) have a width (i.e., a dimension transverse to the longitudinal axis of the shaft (410)) which is greater than the width of the shaft (410). (It should also be noted that the term "bell" is used because of its connotation a widening of the structure, and should not be construed to imply that the interiors of the bells are hollow.) In the preferred embodiment, the toy (400) is cylindrically symmetric about the longitudinal axis (499). Furthermore, in the preferred embodiment the toy (400) has mirror symmetry about a central plane that passes through a midpoint (498) of the toy and to which the longitudinal axis (499) is a normal vector. At their outer ends, the bells (420) are spherical. The width of the shaft (410) flares from a minimum width at its midpoint (498), and the flare of the shaft (410) and the curvature of the shaft (410) where it meets the bells (420) are such that the toy (400) has a smooth outer contour. According to the preferred embodiment there is a continuous first derivative of the contour profile, and more preferably there are continuous first and second derivatives of the contour profile.

Preferably the toy (400) has a length between 40 mm and 80 mm, more preferably between 45 mm and 75 mm, more preferably between 50 mm and 70 mm, and still more preferably between 55 mm and 65 mm. Preferably the outer ends of the bells (420) have a convex radius of curvature between 7 mm and 15 mm, more preferably between 8 mm and 13 mm, and still more preferably between 9 mm and 12 mm. Preferably the shaft (410) at its center point (498) has a width between 5 mm and 12 mm, more preferably between 6 mm and 10 mm, and still more preferably between 7 mm and 9 mm. Preferably the shaft (410) in profile as shown in FIG. 4B has a concave radius of curvature at its midpoint (498) between 25 mm and 45 mm, more preferably between 28 mm and 40 mm, and still more preferably between 32 mm and 37 mm. The radius of curvature of the profile of the shaft (410) increases with distance from the midpoint (498) to inflection points (497), and at inflection points (497) the curvature of the profile changes from concave to convex. Preferably the toy (400) is made of a non-flexible material such as wood, metal, or plastic.

According to a first preferred embodiment, the toy (400) is made of wood and has a length of 60 mm, the outer ends of the bells (420) have a convex radius of curvature of 10 mm, the shaft (410) at its center point (498) is 8 mm in width, and the shaft (410) in profile as shown in FIG. 4B has a concave radius of curvature at its midpoint (498) of roughly 34 mm. As described in detail below, these dimensions have been chosen because they facilitate finger manipulations of the toy (400) and allow for new types of tricks and maneuvers to be performed.

Figure 5A:
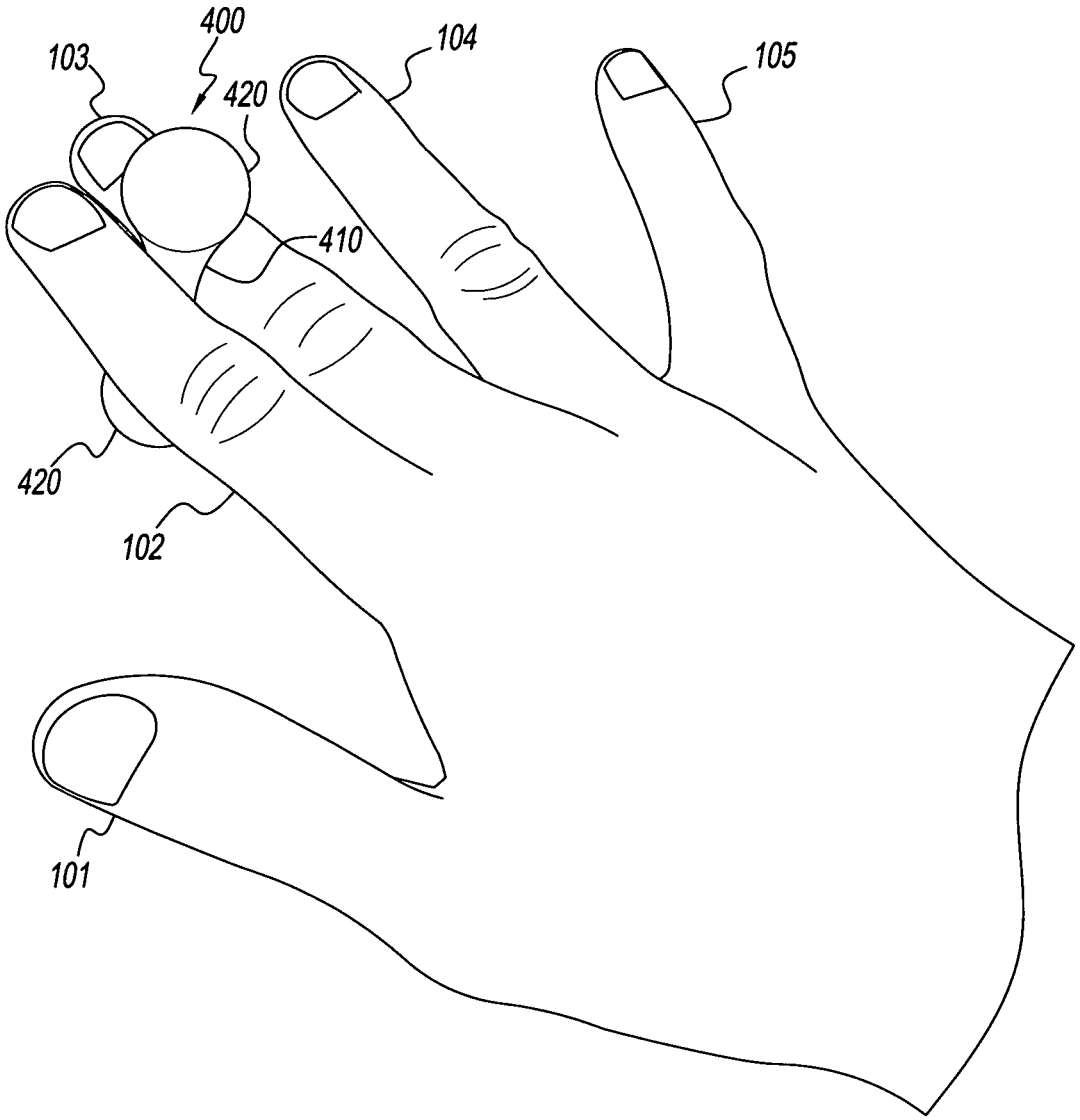
FIGS. 5A through 5D show a time sequence of the toy of FIGS. 4A and 4B being rolled over the back of the middle and ring fingers.
Figure 5B:
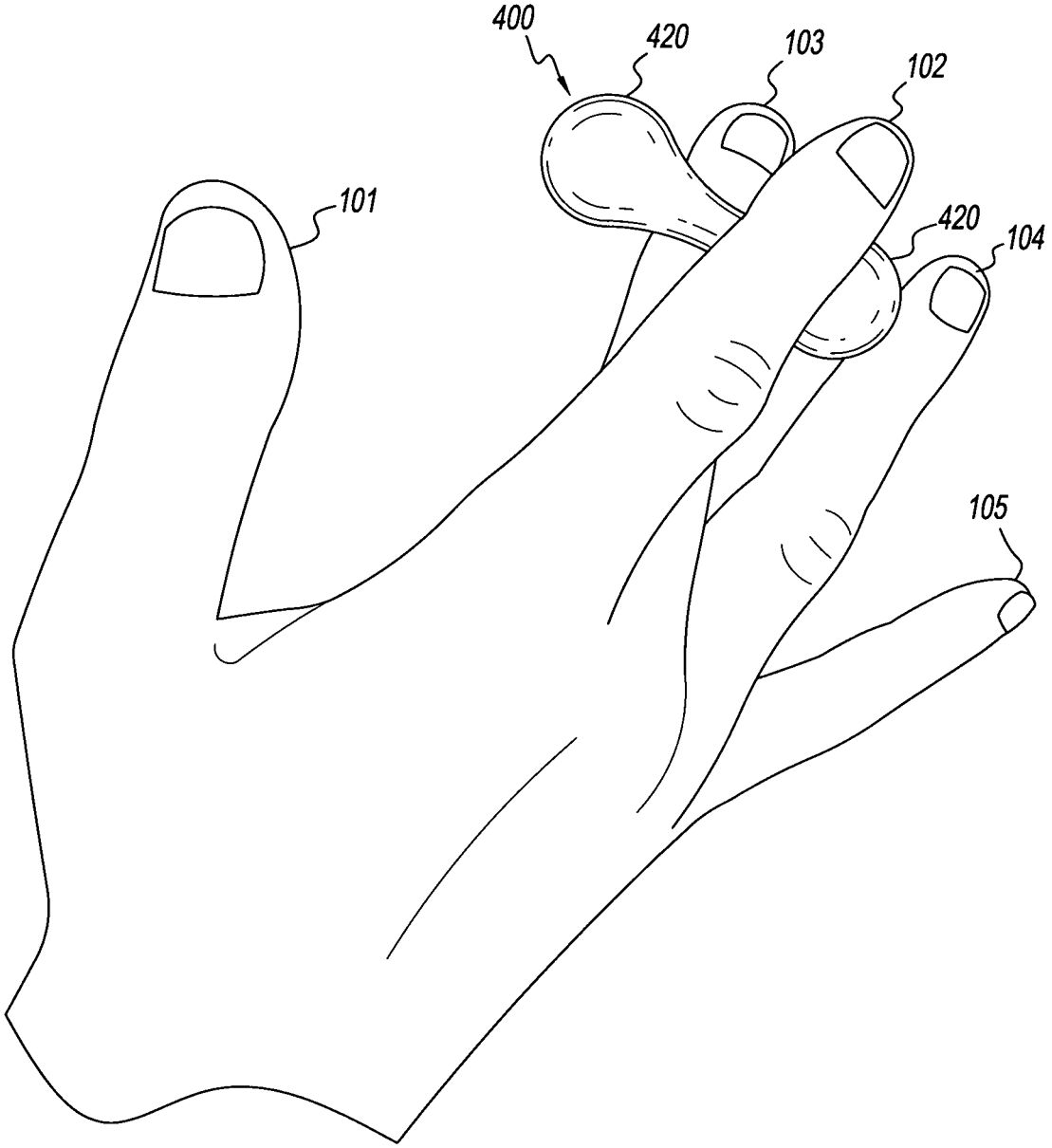
Figure 5C:
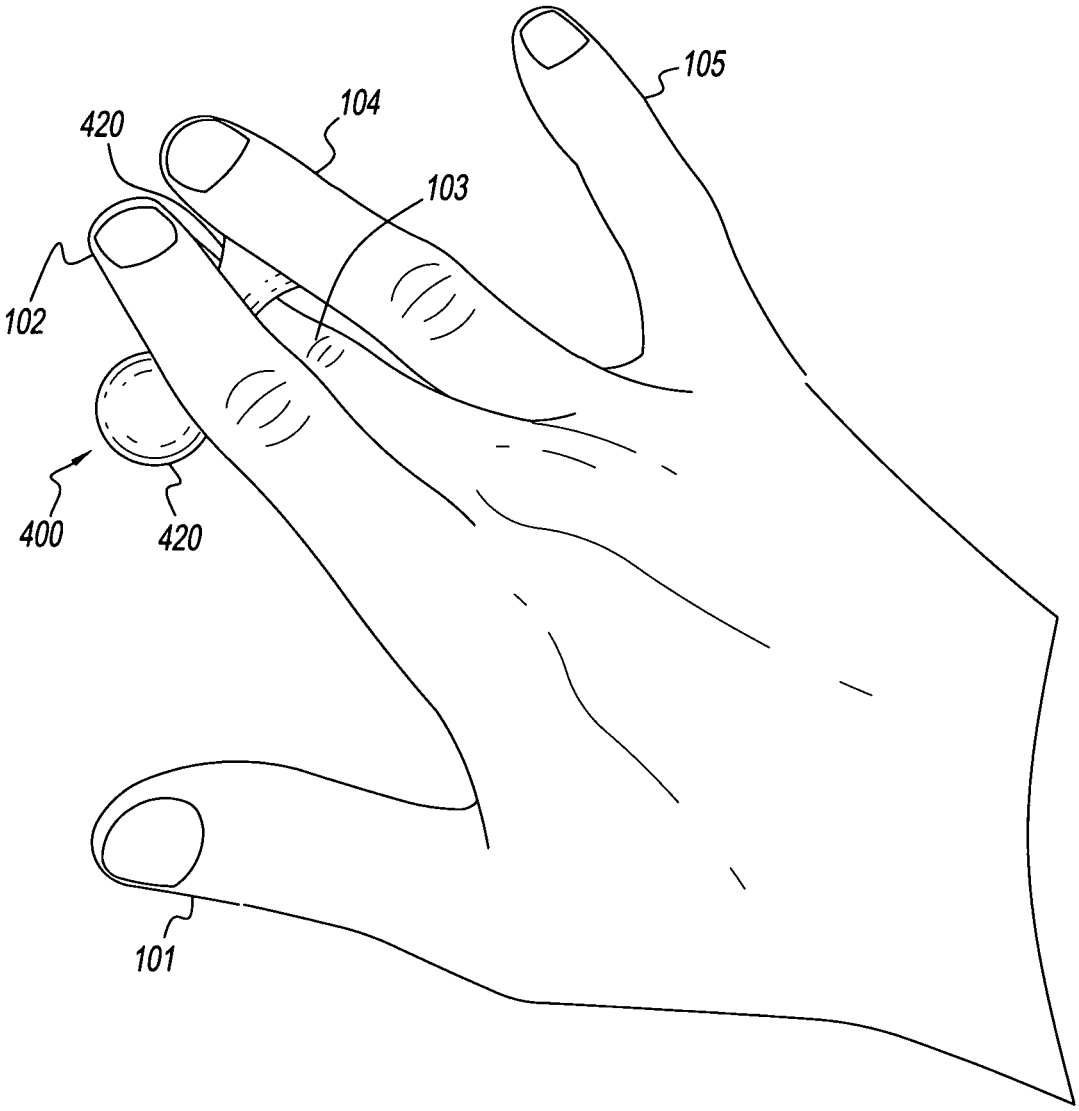
Figure 5D:
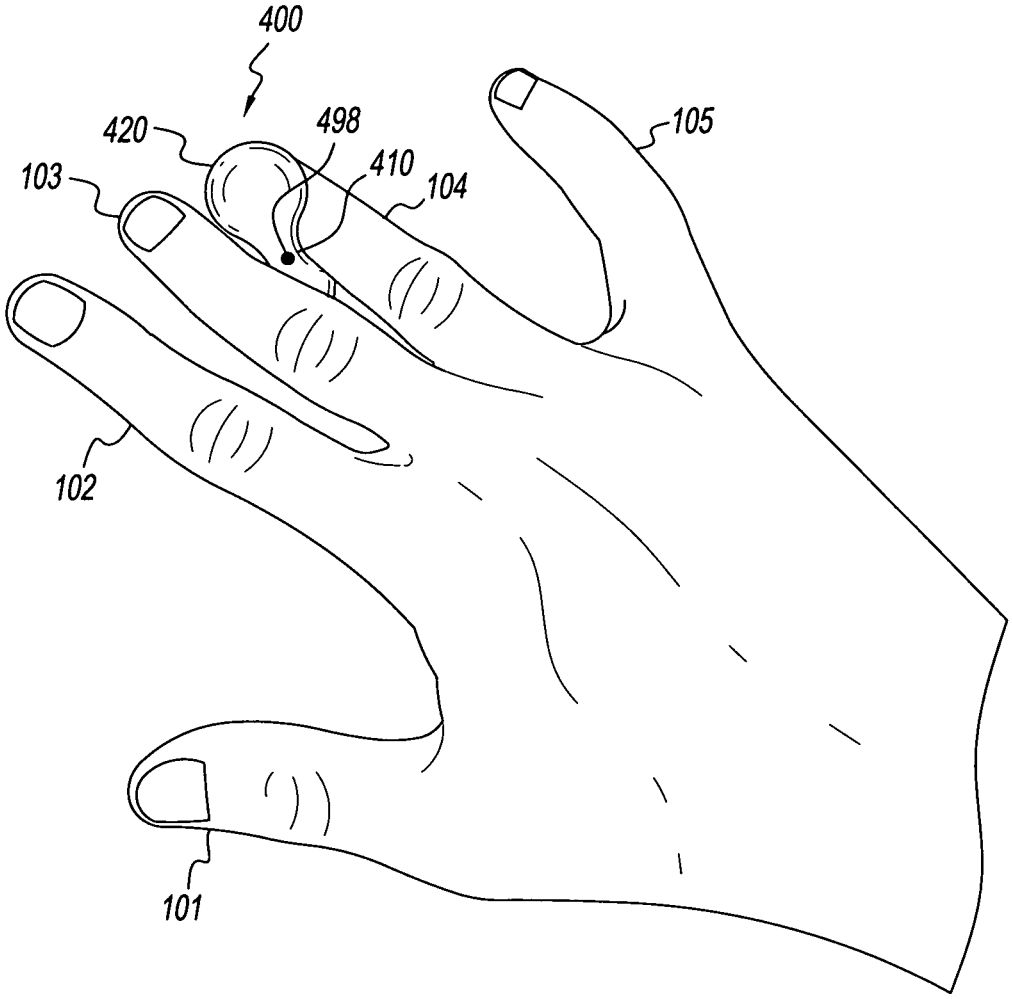

A basic maneuver with the skill toy (400) of the present invention is shown in FIGS. 5A through 5D. In FIG. 5A the toy (400) is held between the index finger (102) and the middle finger (103). By raising the index finger (102) and moving the index finger (102) rightwards relative to the middle finger (103), the toy (400) rotates clockwise, as is shown in FIG. 5B, so that ring finger (104) can be placed over the right-hand bell (420), as is shown in FIG. 5C. (It should be noted that all directional references in the present specification are made with reference to the orientations of the fingers (100) and toy (400), coin 110), pen (210) or ball (310) shown in the figure or figures which accompany the description. Furthermore, it should be noted that statements regarding movements of the fingers (100) may be made without explicitly stating that such movements are relative to the positions of neighboring fingers (100).) Then by removing contact of the index finger (102) with the toy (400) and moving the ring finger (104) downwards so it is even with the middle finger (103), the toy (400) becomes held between the middle finger (103) and the ring finger (104) in an orientation normal to the plane of the palm (which will be referred to herein as a vertical orientation), as is shown in FIG. 5D. Hence the toy (400) has been "rolled" over the back of the middle finger (103) from between the index finger (102) and the middle finger (103) to be between the middle finger (103) and the ring finger (104).

This rolling maneuver can be reversed by reversing the above-described motions so the toy (400) returns to be positioned between the index finger (102) and the middle finger (103). Or the rolling maneuver can be continued by rolling the toy (400) over the ring finger (104) so it comes to be positioned between the pinky finger (105) and the ring finger (104) by raising the middle finger (103) and moving it rightwards relative to the ring finger (104) so as to rotate the toy (400) clockwise towards the pinky finger (105), as is shown in FIG. 5D. This allows the pinky finger (105) to be placed on top of the righthand bell (420). Then by moving the middle finger (103) off the lefthand bell (420) and moving the pinky finger (105) downwards, the toy (400) becomes positioned between the pinky finger (105) and the ring finger (104), as is shown in FIG. 5E.

Figure 1A:
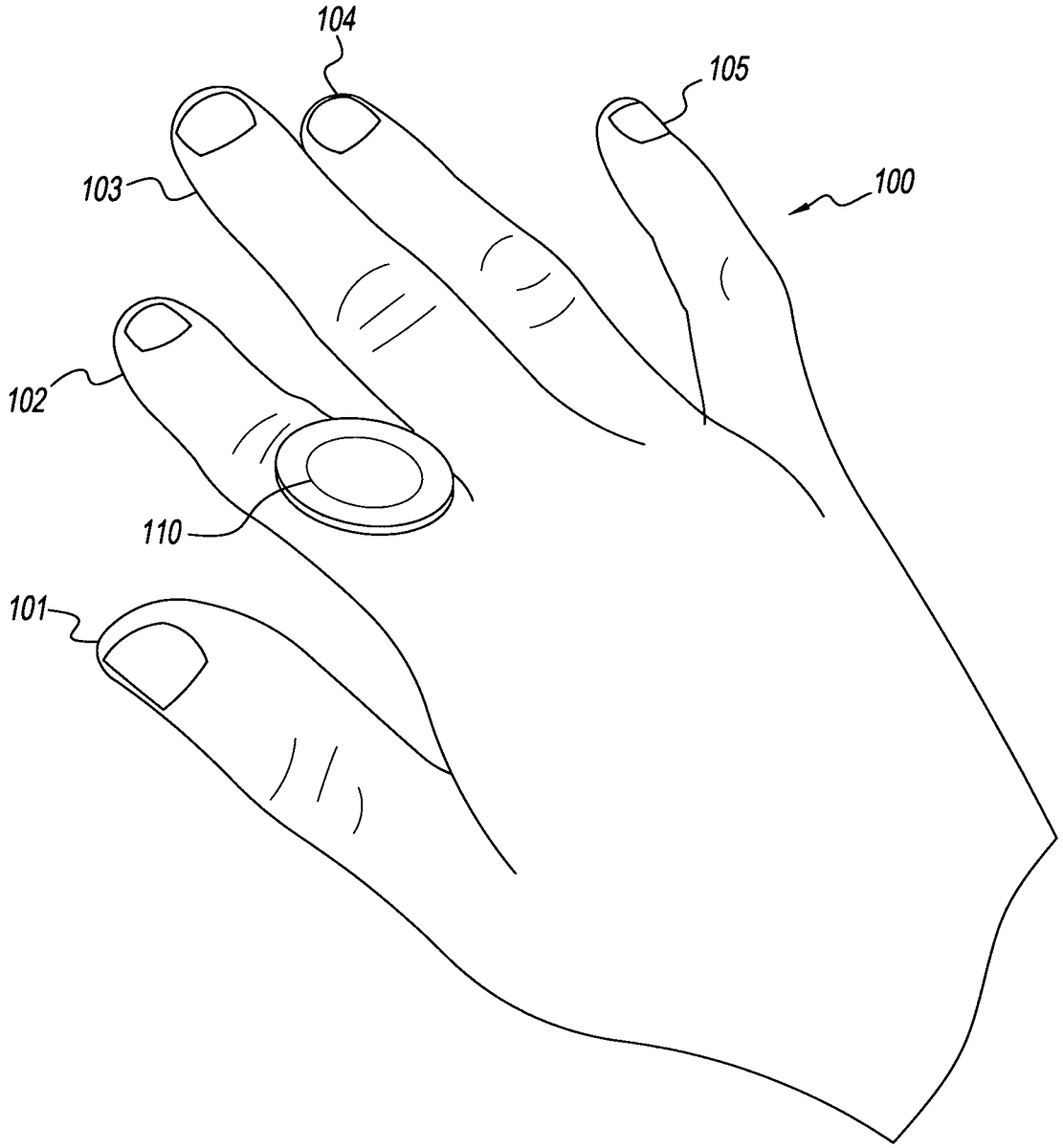
FIGS. 1A through 1C show a time sequence of a coin being rolled over the back of the middle finger.
Figure 1B:
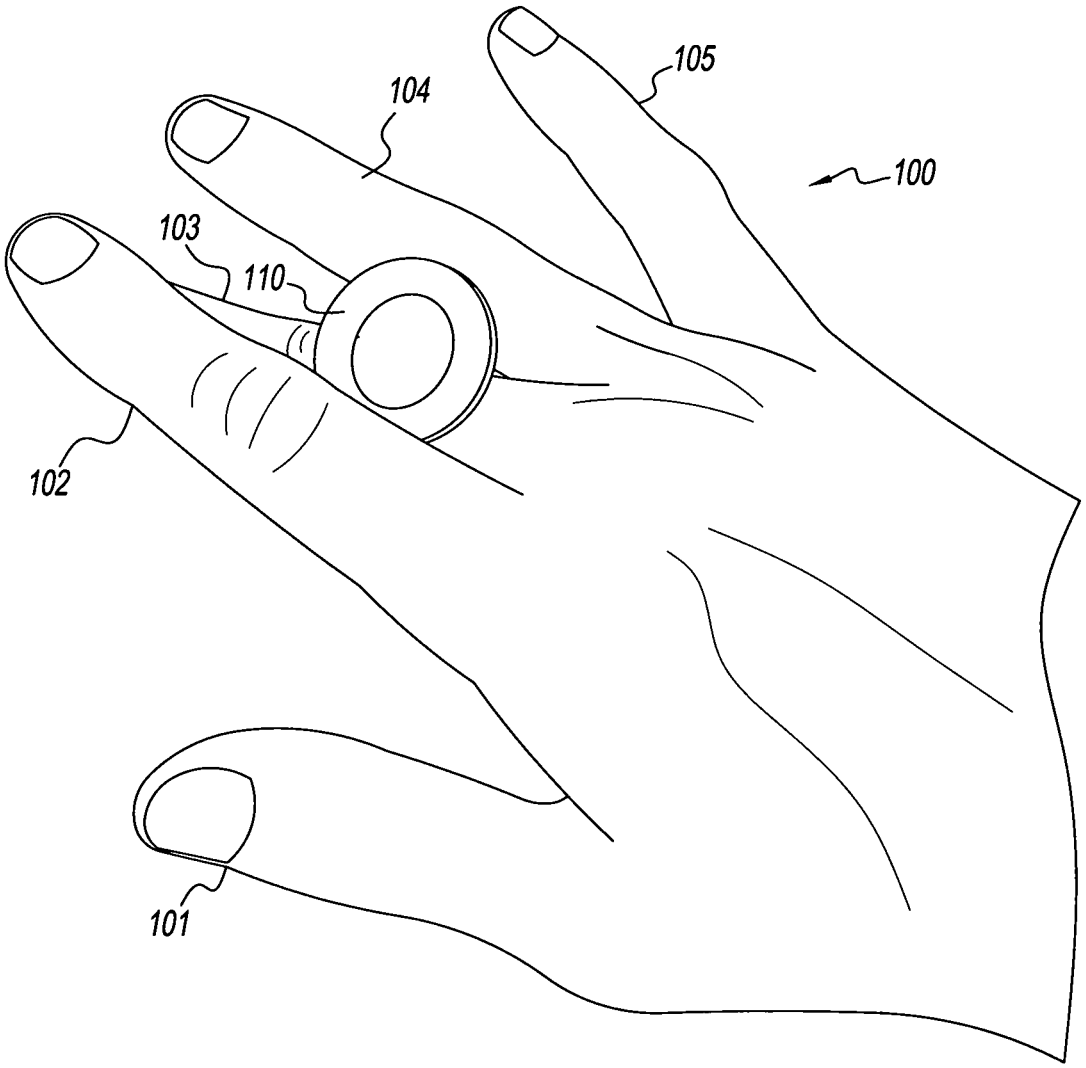
Figure 1C:
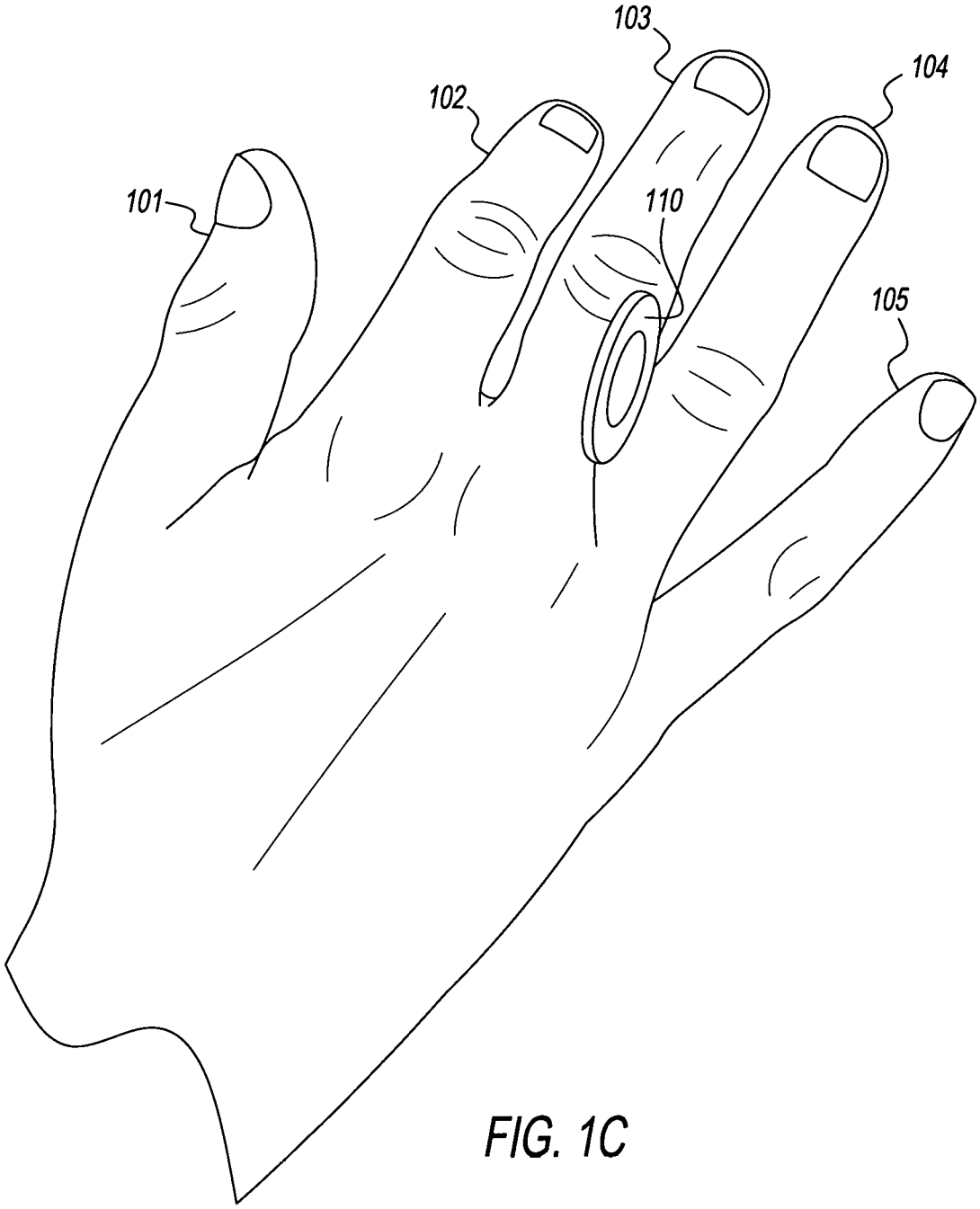

To understand the advantages of the toy (400) of the present invention it is useful to compare the rolling maneuver shown in FIGS. 5A-5D with the rolling maneuver performed with a coin (110) in FIGS. 1A-1C. A coin typically has a thickness of around 1 to 2 mm while, as described above, the toy of the present invention has a thickness of 8 mm at its midpoint and 20 mm at the bells (420). The thinness of the coin (110) and the lack of variation in the thickness of the coin (110) make the coin (100) much more difficult to hold and to manipulate. To prevent the coin (110) from falling through the fingers (100) the fingers (100) must be held closely together. In contrast, with the toy (400) of the present invention the fingers can be separated by anywhere between 8 mm (if the toy (400) is held at its midpoint (498)) to slightly around 20 mm (if the toy (400) is held at a bell (420)). Additionally, holding the fingers (100) close enough together to hold the coin (110) makes manipulating its position and/or orientation difficult. In contrast, the freedom provided in the separation of the fingers (100) by the toy (400) of the present invention makes manipulating the position and/or orientation of the toy (400) easier because more natural finger movements and finger movements involving a greater range of motion are allowed.

Figure 6A:
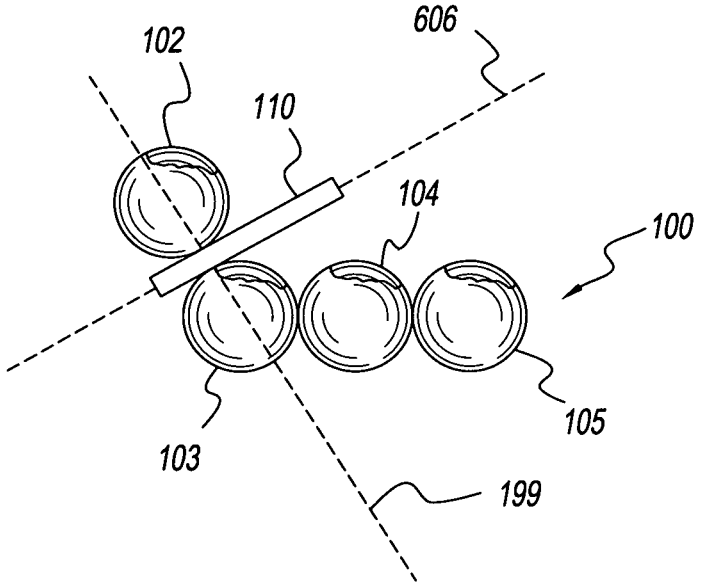
FIG. 6A shows a schematic view of the orientation of the coin as the index finger moves above the middle finger illustrating that there is a 90° angle between the plane of the coin and the vector between the fingers.
Figure 6B:
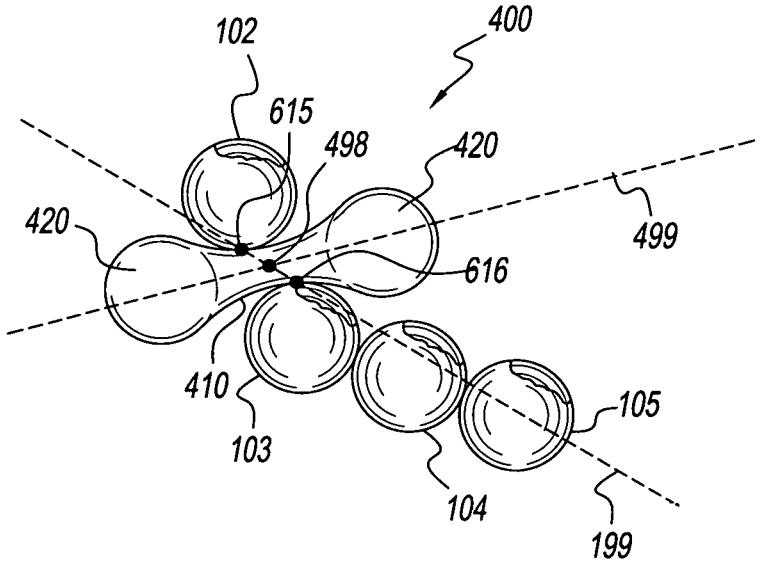
FIG. 6B shows a schematic view of the orientation of the coin as the index finger moves above the middle finger illustrating that the angle between the plane of the longitudinal axis of the toy and the vector between the fingers can be greater than 90°.

Furthermore, the concave contour of the profile of the toy (400) at the midpoint (498) provides an important amplifying effect between the position of the fingers (100) holding the toy (400) and the orientation of the toy (400). FIG. 6A shows a schematic of the orientation of the coin (110) with the index finger (102) above the middle finger (103) as viewed looking down the ends of the fingers (100). As can be seen in FIG. 6A, the angle between a line (199) through the centers of the index finger (102) and the middle finger (103) is offset by 90° from the plane (606) of the coin (110). In contrast, as shown in the schematic end view of FIG. 6B, when the index finger (102) is moved above the middle finger (103) and the toy (400) is in motion/pivoting, the index finger (102) may contact the toy (400) at a point (615) to the left of the midpoint (498) and the middle finger (103) may contact the toy (400) at a point (616) to the right of the midpoint (498), and therefore the longitudinal axis (499) of the toy (400) may have an orientation which is offset by greater than 90° from a line (199) between the centers of the index finger (102) and middle finger (103). This amplification effect assists in performing maneuvers such as the rolling maneuver shown in FIGS. 5A-5D.

Furthermore, the bells (420) provide additional weight to the toy (400) at its extremities, which increases the moment of inertia of the toy (400) relative to if it had the same thickness at its extremities that it has at its midpoint (498). This provides the important advantage that the angular momentum of the toy (400) can be used to facilitate maneuvers. For instance, in rolling the toy (400) over the middle finger (103), as is shown in FIGS. 5A through 5D, if an angular velocity is imparted to the toy (400) the angular momentum of the toy (400) can assist in reaching the orientation of FIG. 5C where the toy (400) is horizontal and the ring finger (104) can be placed on top of the rightmost bell (420). This is just one of many maneuvers where the angular momentum of the toy (400) can be helpful.

Figure 2A:
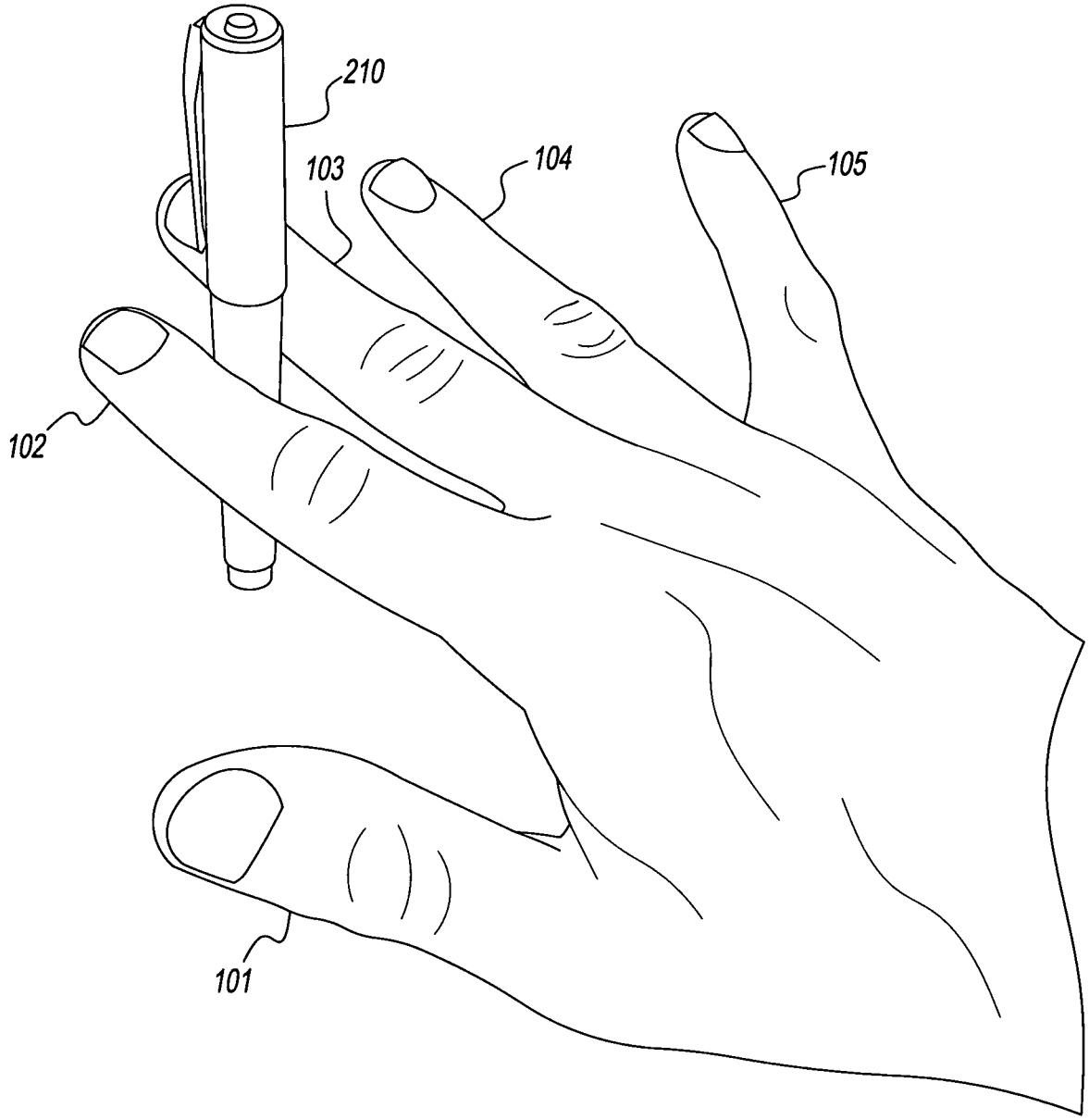
FIGS. 2A through 2F show a time sequence of a pen being spun over the back of the middle finger.
Figure 2B:
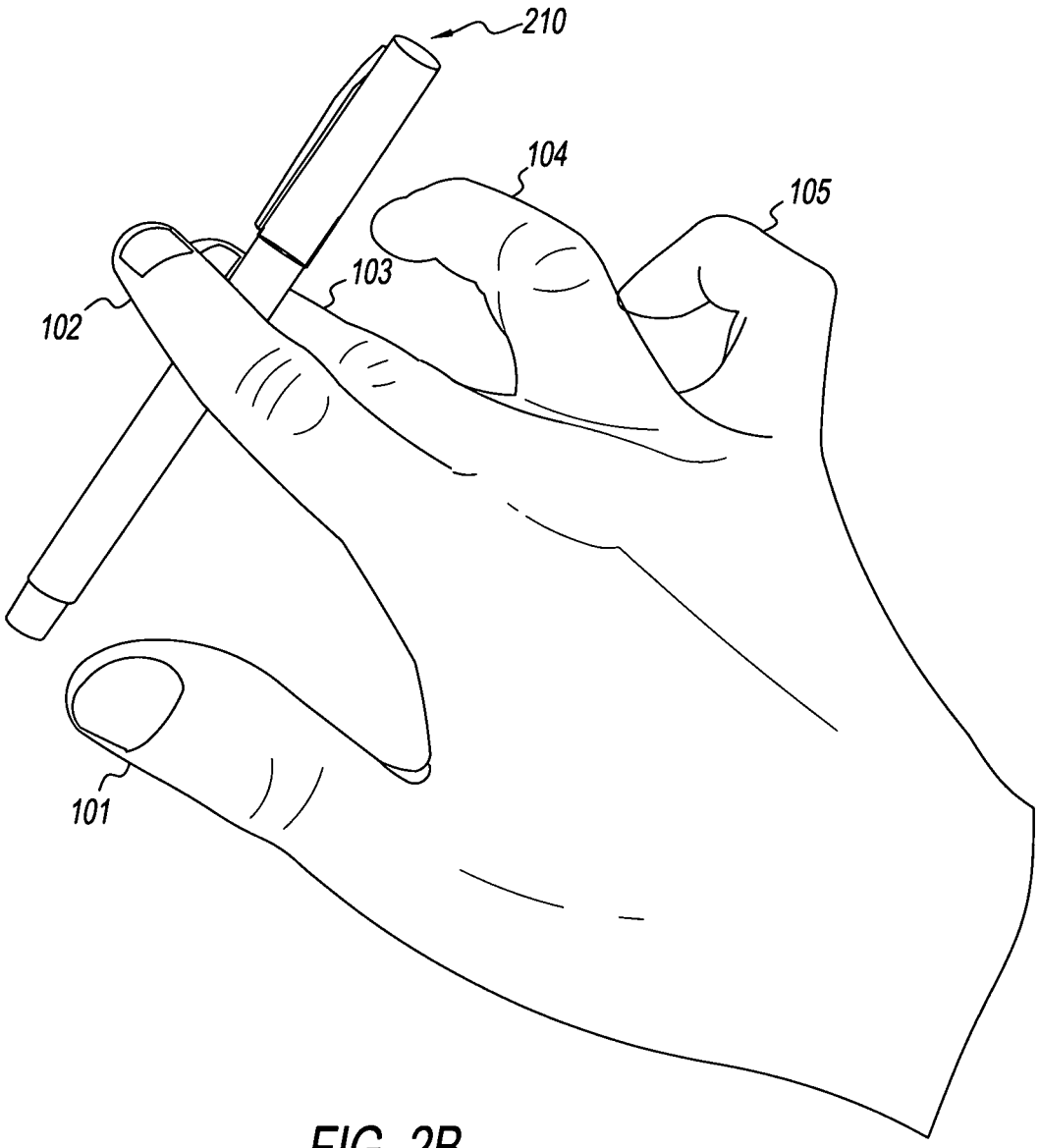
Figure 2C:
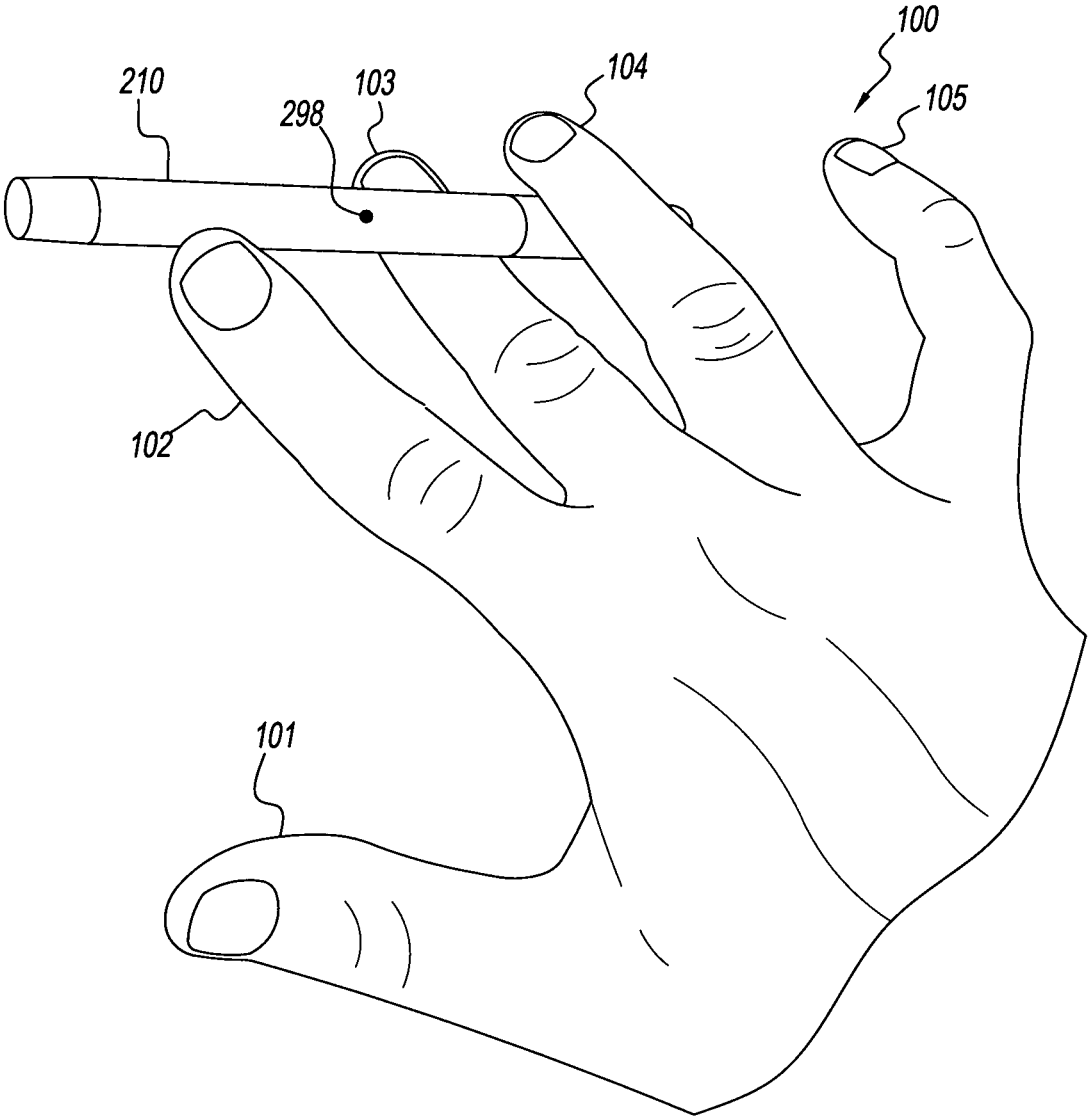
Figure 2D:
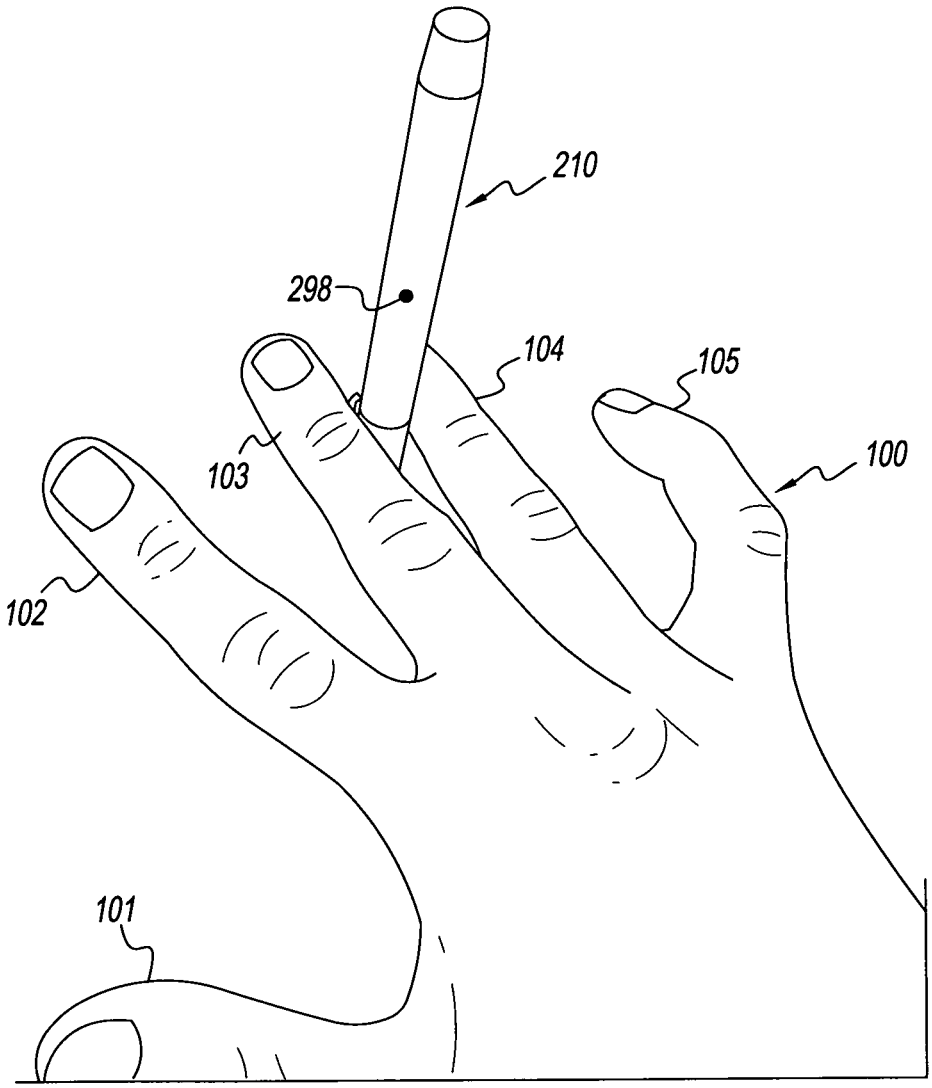

To further understand the advantages of the toy (400) of the present invention it is also useful to compare the rolling maneuver shown in FIGS. 5A-5D with the spinning maneuver with a pen (200) shown in FIGS. 2A-2F. In FIG. 2A the pen (200) is held between the index finger (102) and the middle finger (103). By raising the index finger (102) and moving the index finger (102) rightwards relative to the middle finger (103), the pen (200) rotates clockwise as shown in FIG. 2B. When the pen (200) has rotated so that it is nearly horizontal, the ring finger (104) can be placed over the pen (200), as is shown in FIG. 2C. Then by removing contact of the index finger (102) with the pen (200) and moving the ring finger (104) downwards so it is even with the middle finger (103), the pen (200) becomes held between the middle finger (103) and the ring (104) in a vertical orientation, as is shown in FIG. 2D.

Figure 2E:
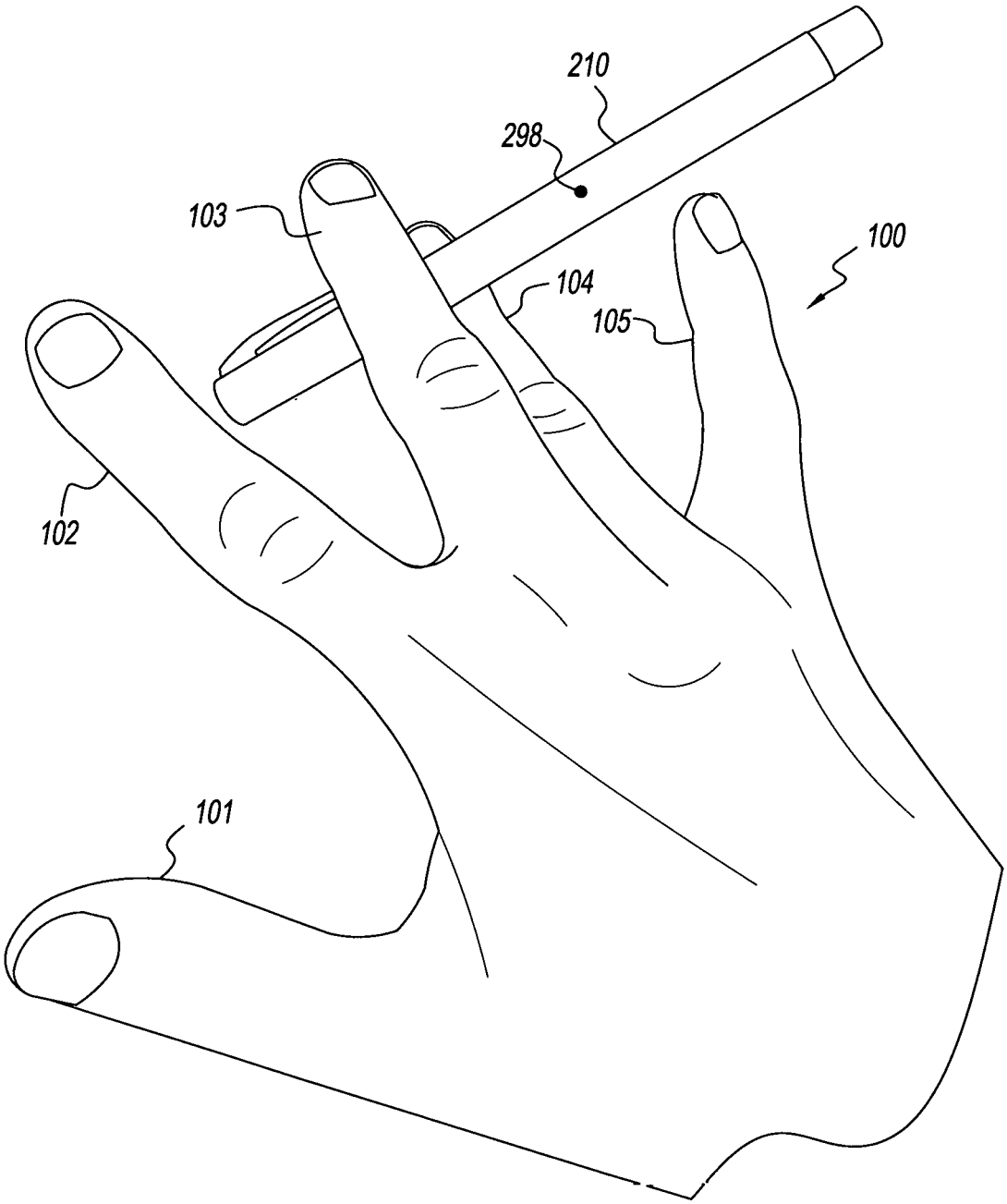
Figure 2F:
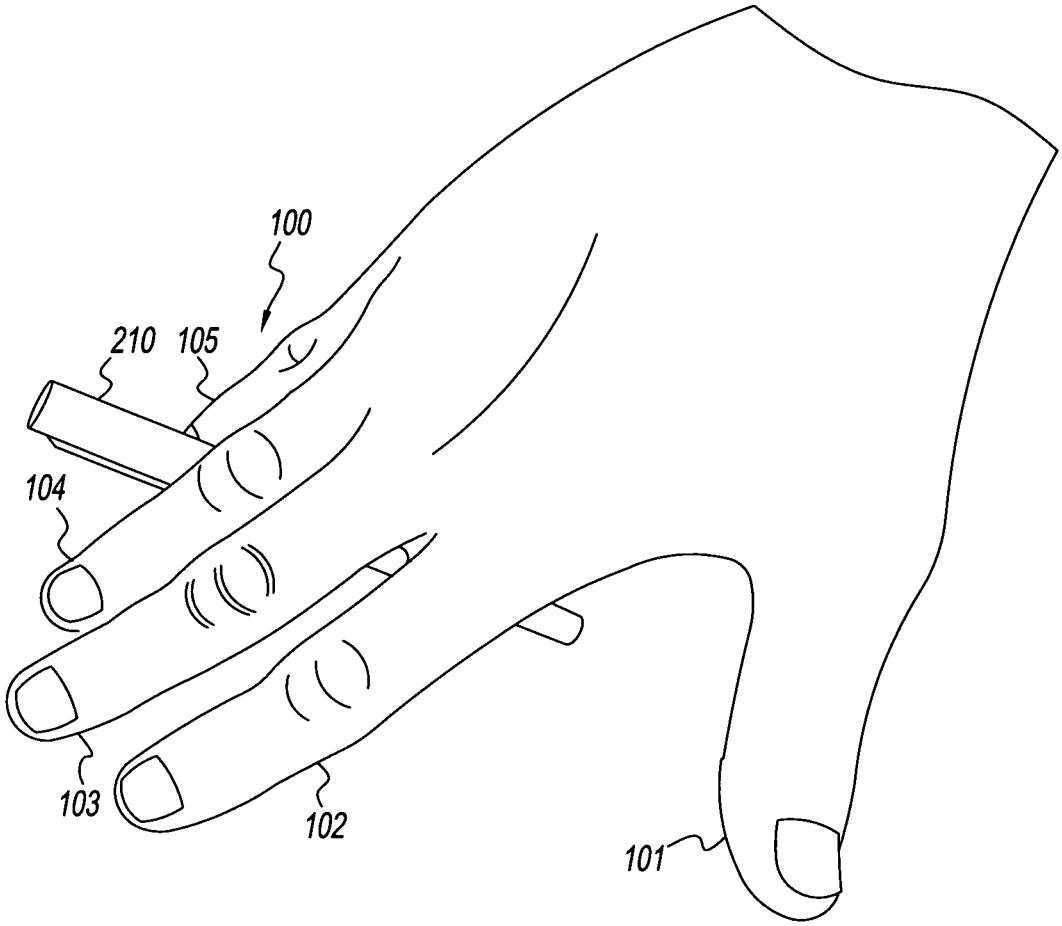
Figure 3A:
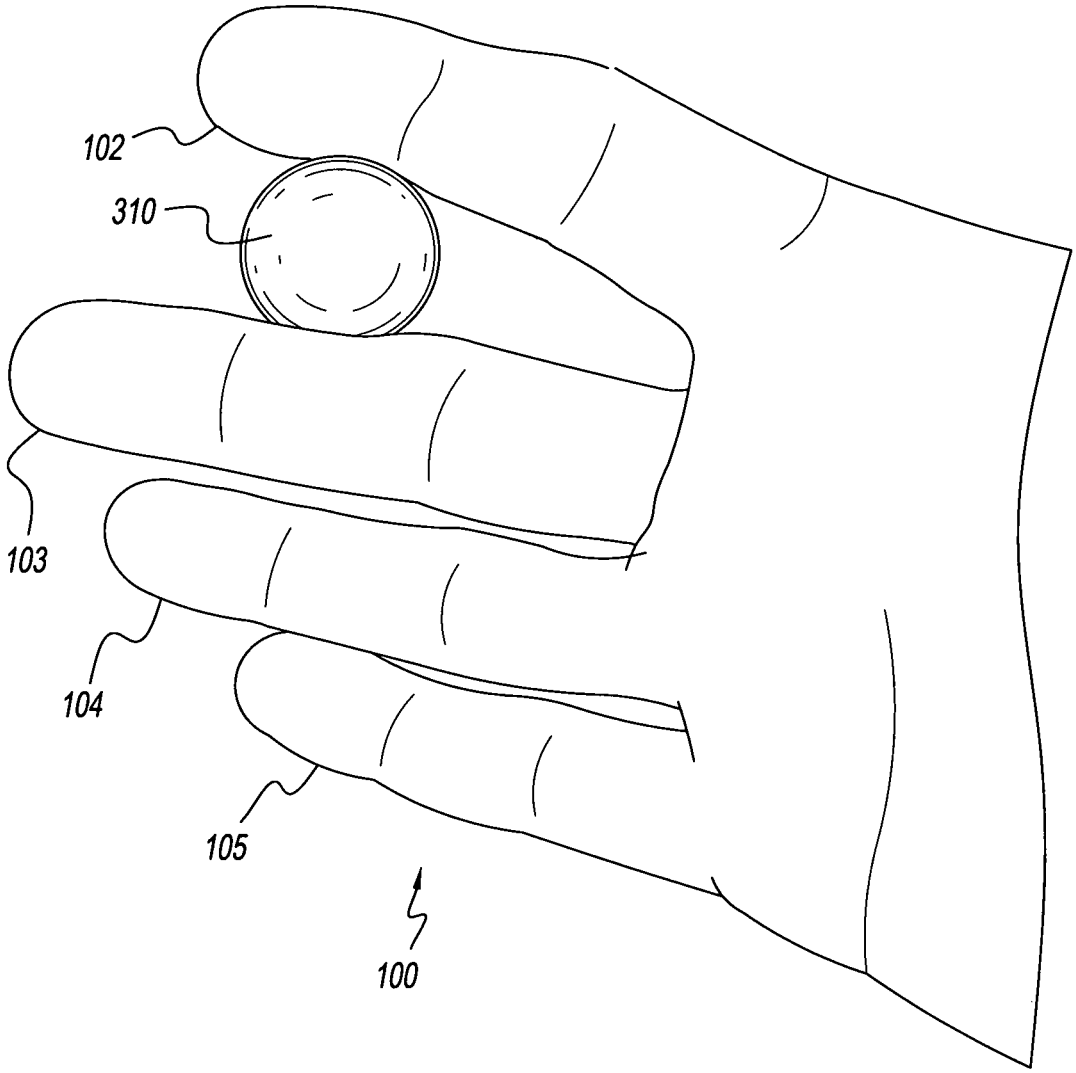
FIGS. 3A through 3C show a time sequence of a ball being rolled over the back of a finger.
Figure 3B:
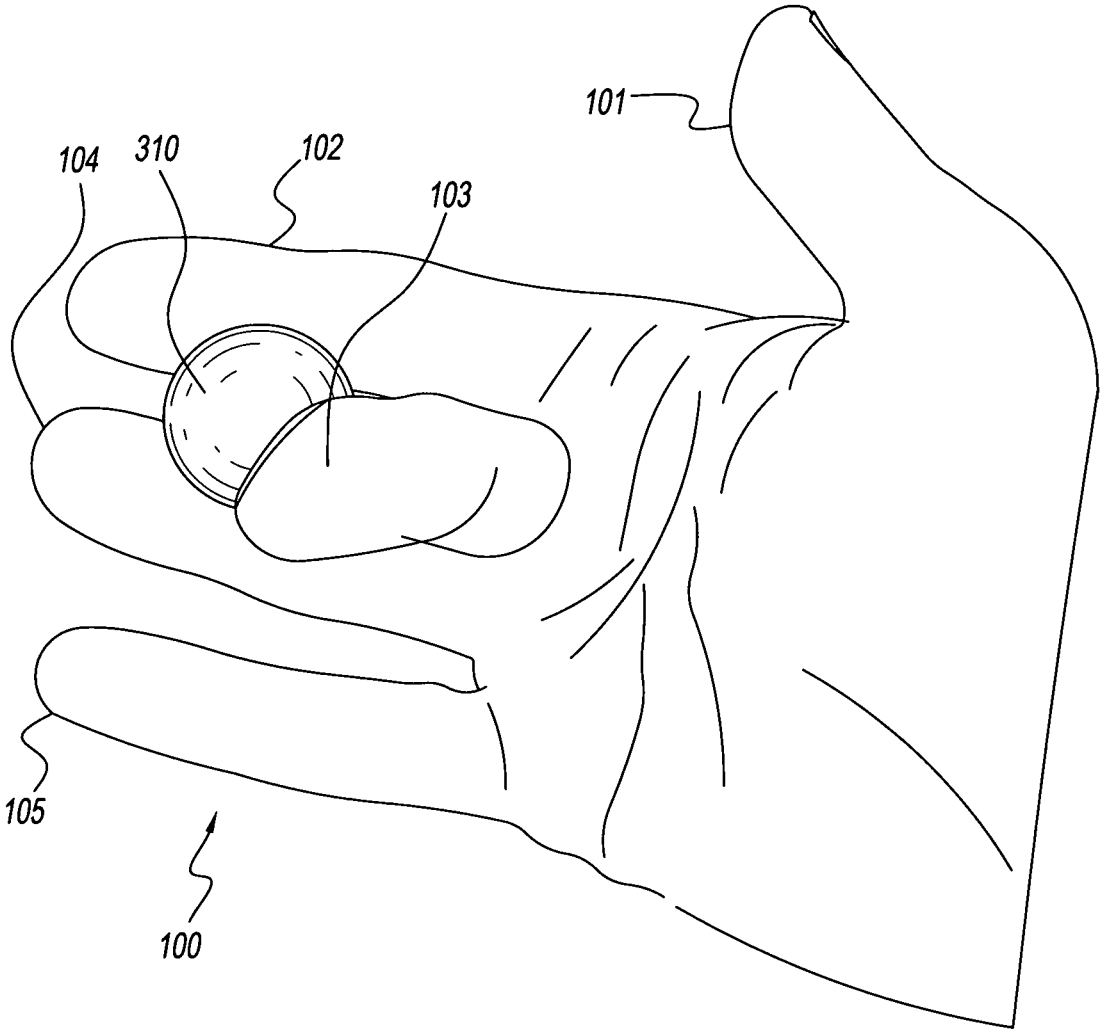
Figure 3C:
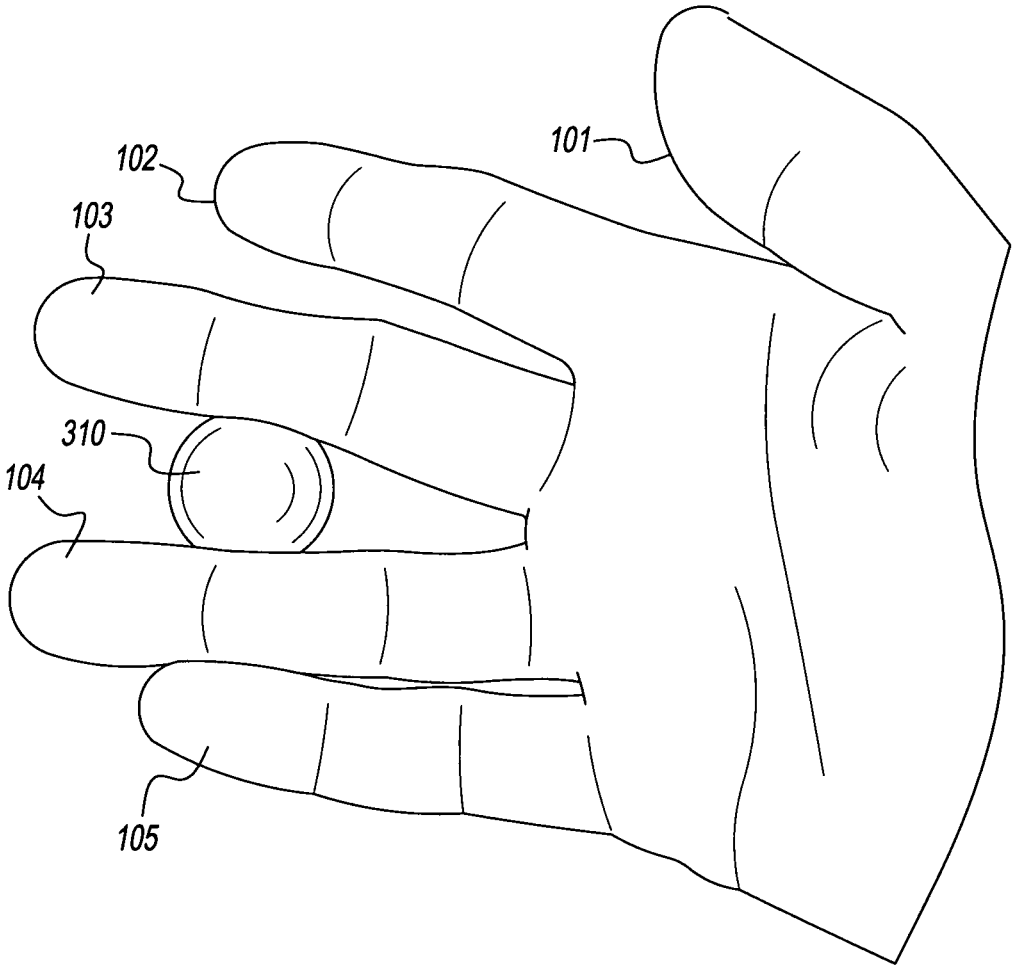

It should be noted that the location of the center point (298) of the pen (200) has changed substantially in the course of rolling of the pen (200) over the middle finger (103). In FIG. 2A the center point (298) of the pen (200) is near the fingers (100), while in FIG. 2D the centerpoint (298) of the pen (200) is substantially above the fingers. This uncentering is further exacerbated in rolling the pen (210) to be held between the pinky finger (105) and ring finger (104), as is shown in FIGS. 2E and 2F. This uncentering can cause problems where the operator runs out of pen to hold onto. This is to be contrasted with FIGS. 5A and 5D where before and after the toy (400) has been rolled over the middle finger (103), respectively, the midpoint (498) of the shaft (410) of the toy (400) is centered with the fingers (100), i.e., the midpoint (498) of the shaft (410) is in the plane of the fingers (100).

Figure 7A:
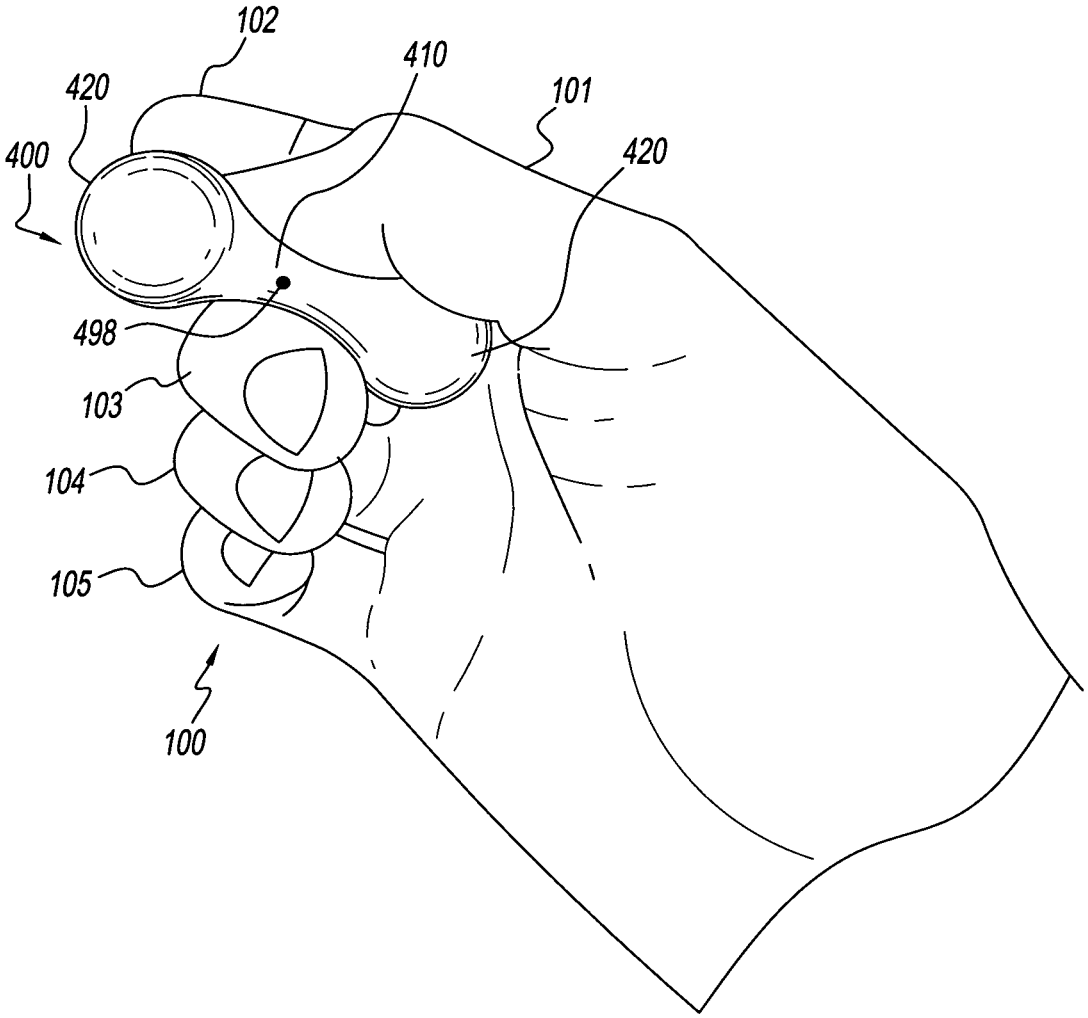
FIGS. 7A through 7E show a time sequence of a maneuver enabled by the convex central contour of the toy of the present invention where it is pushed around the circumference of the thumb by the index finger.
Figure 7B:
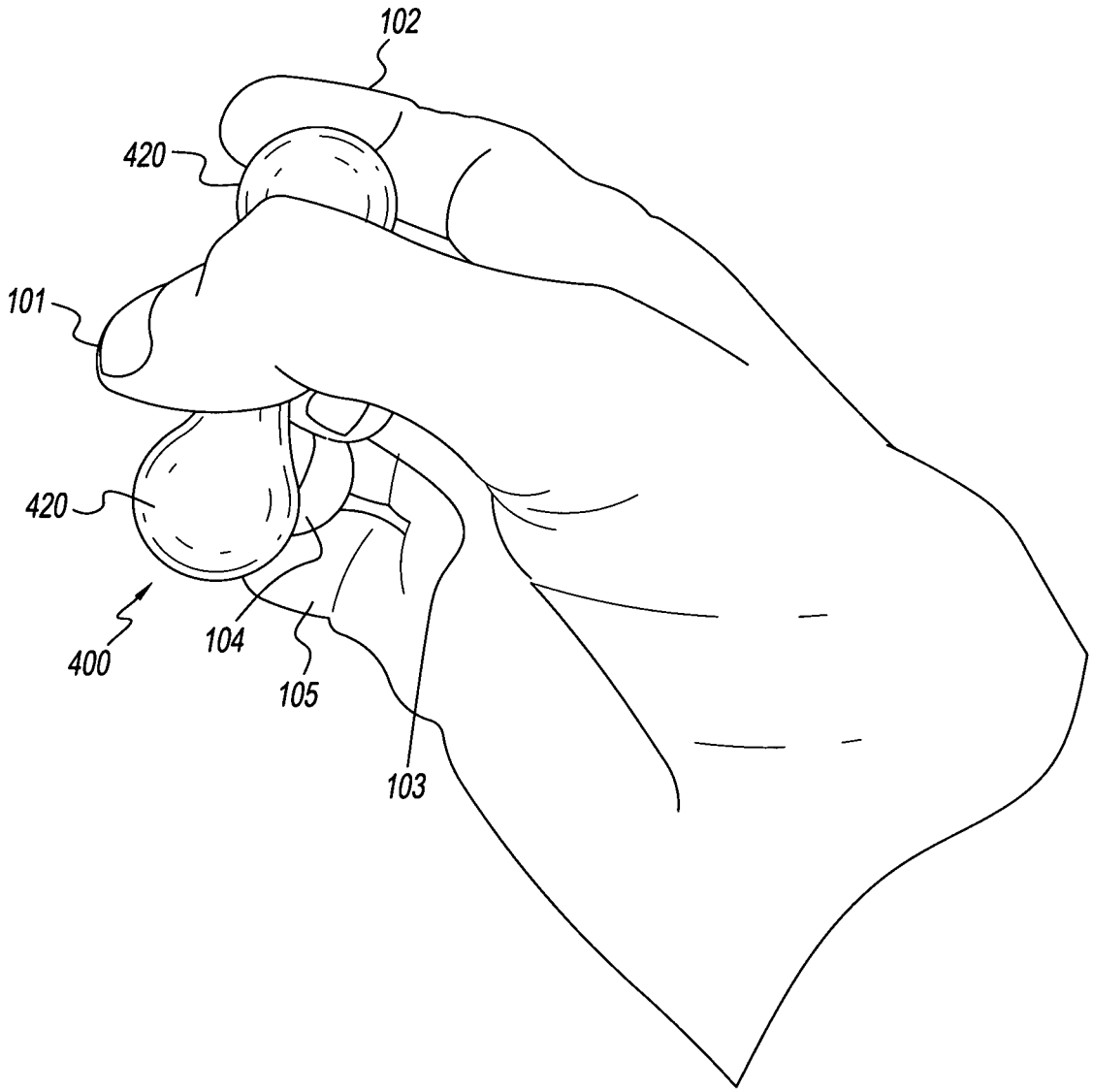
Figure 7C:
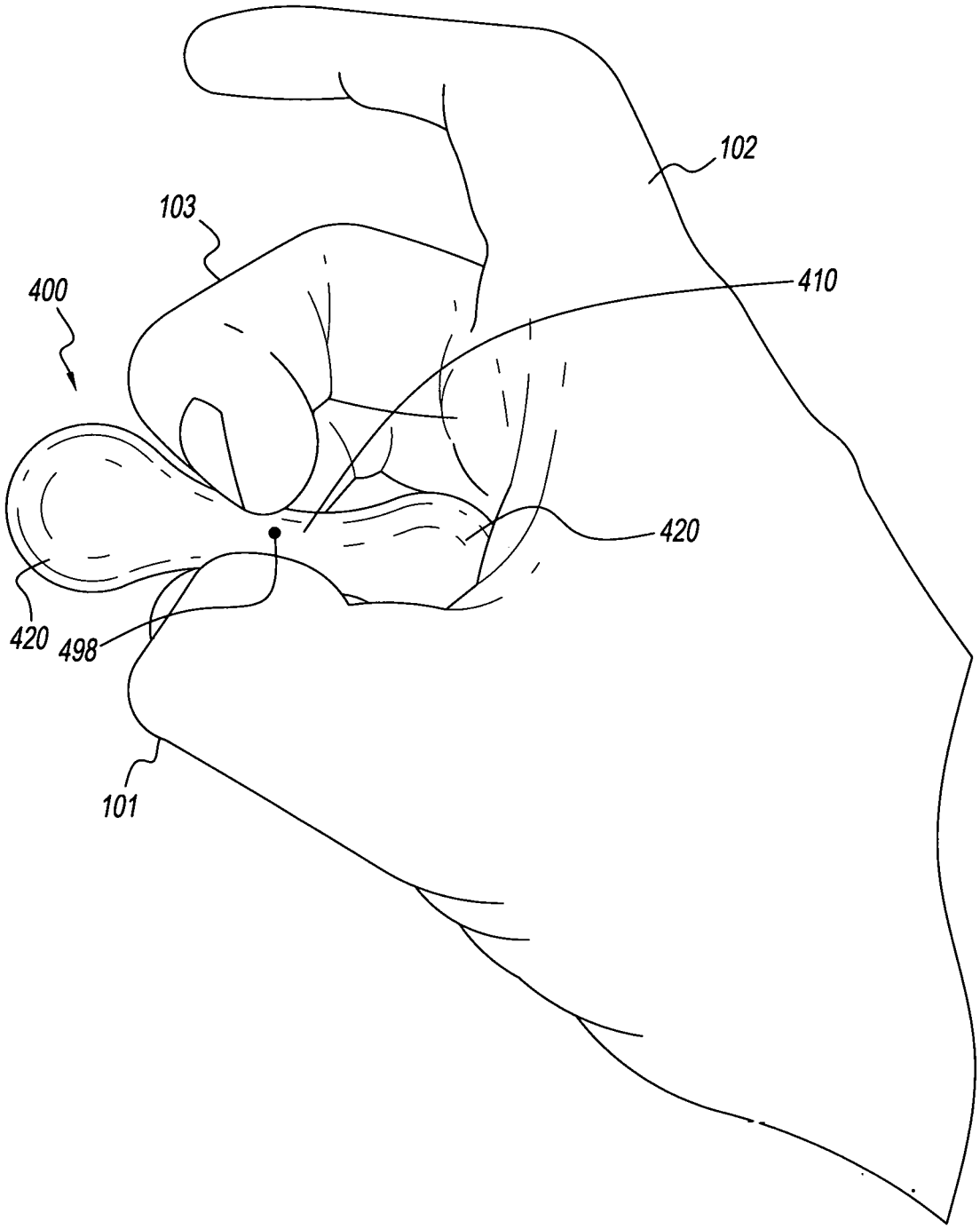
Figure 7D:
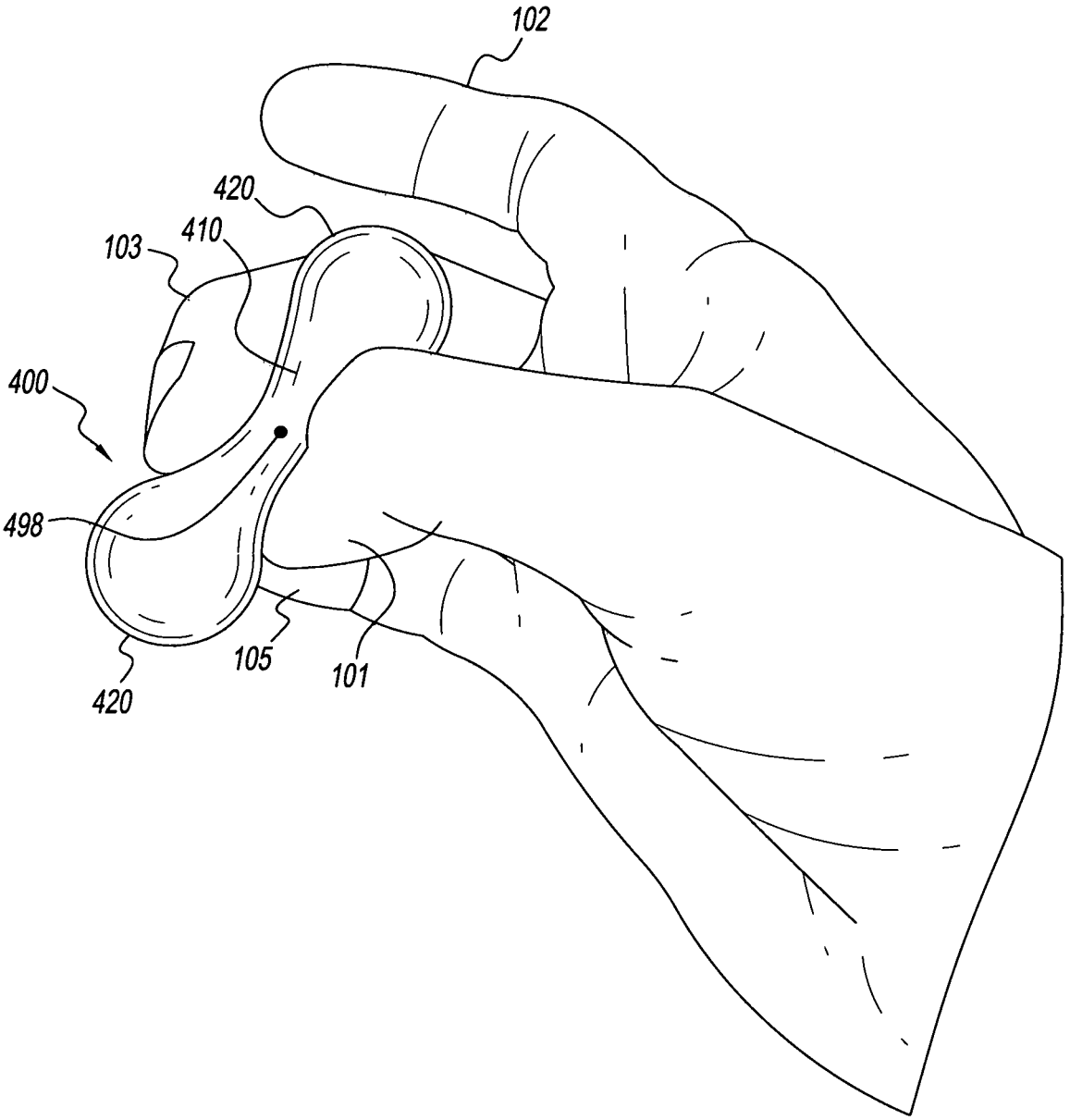
Figure 7E:
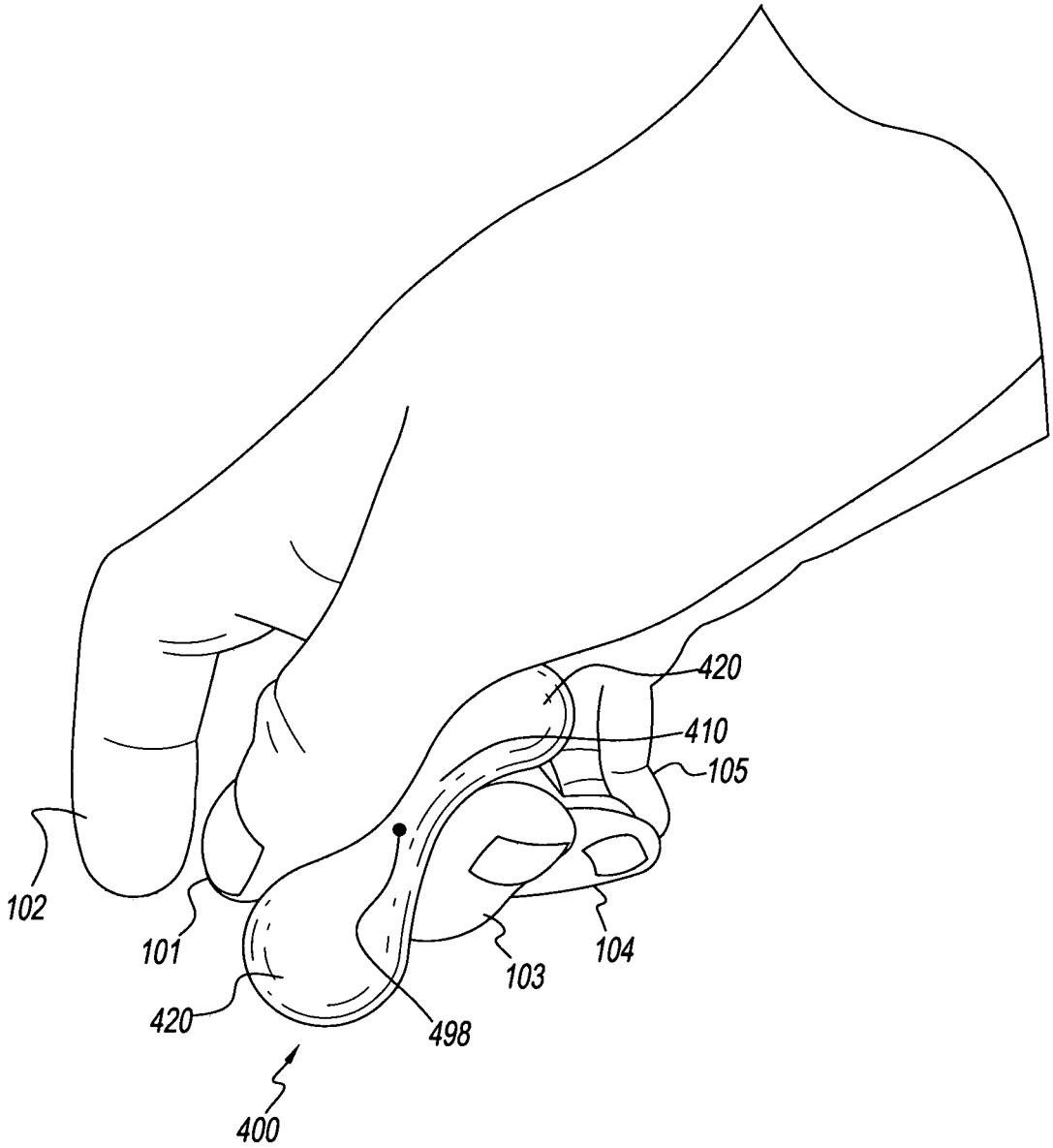

Another example of a maneuver where the shape of the toy (400) of the present invention provides an important centering advantage is shown in FIGS. 7A-7E where the index finger (103) pushes the toy (400) around the thumb (101). Although this maneuver is depicted in FIGS. 7A-7E as starting and ending on the left side of the thumb (101), it can begin and end at other positions on the thumb (101). In FIG. 7A, the toy (400) of the present invention is held between the index finger (103) and the left side of the thumb (101). The encircling of the thumb (101) with the toy (400) of the present invention begins as shown in FIG. 7B where the index finger (103) pushes the toy (400) under the thumb (101). The index finger (103) continues to push the toy (400) around the thumb (101). As shown in FIG. 7C, the toy (400) is in contact with the right side of the thumb (101) and then, as shown in FIG. 7D, the toy (400) is in contact with the top of the thumb (101) and then, as shown in FIG. 7E, the toy (400) is in contact with the left side of the thumb (101). It should be noted that through the entirety of the maneuver shown in FIGS. 7A-7E, the concavity of the profile of the toy (400) at its center point (498) functions to center the toy (400) so that the midpoint (498) of the toy (400) is in contact with the thumb (101).

Figure 8A:
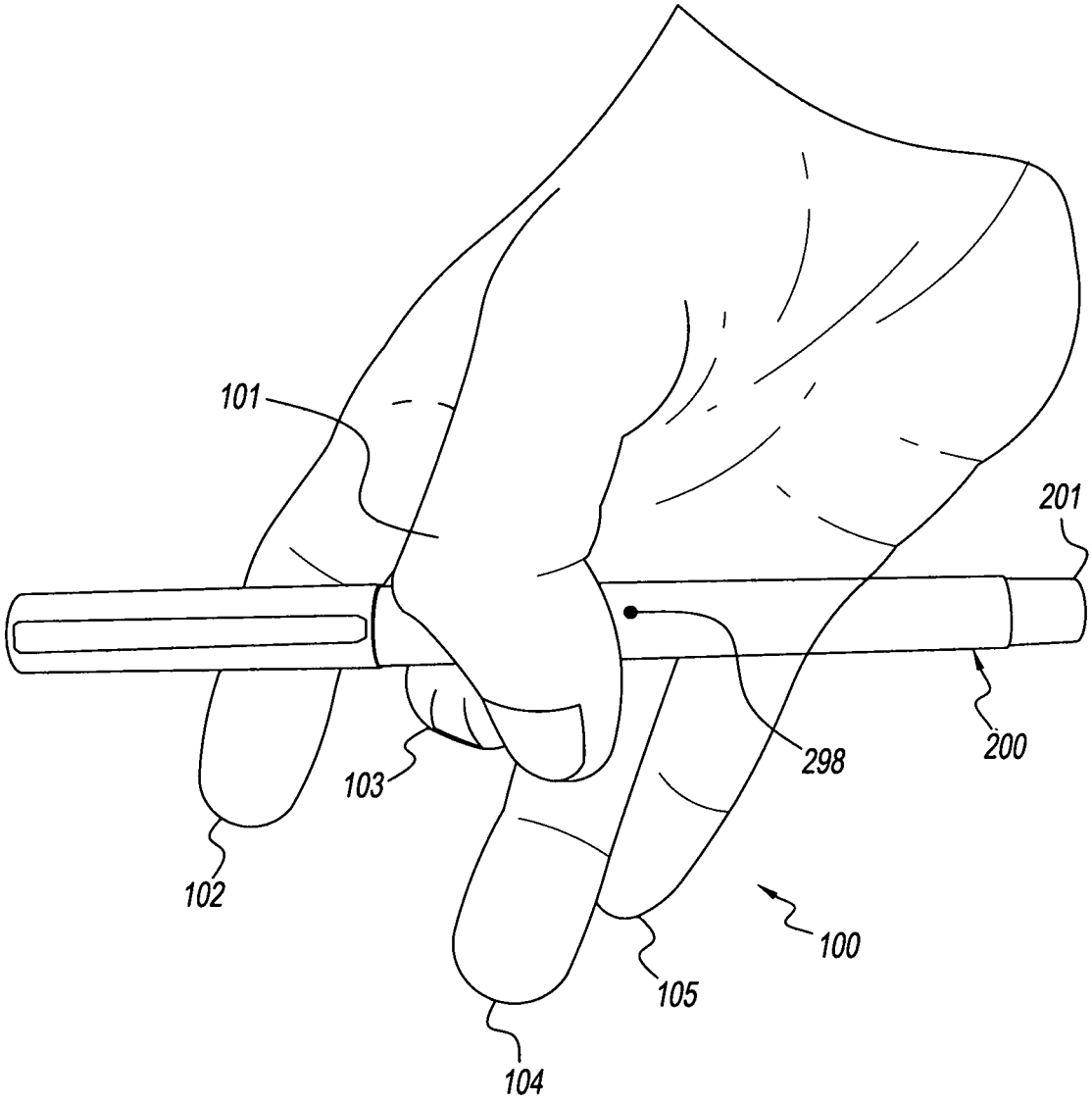
FIGS. 8A through 8B show a time sequence of the thumb-circling maneuver of FIGS. 7A through 7E instead performed with a pen to illustrate how a convex central contour is required to enable extended performance of this maneuver.
Figure 8B:
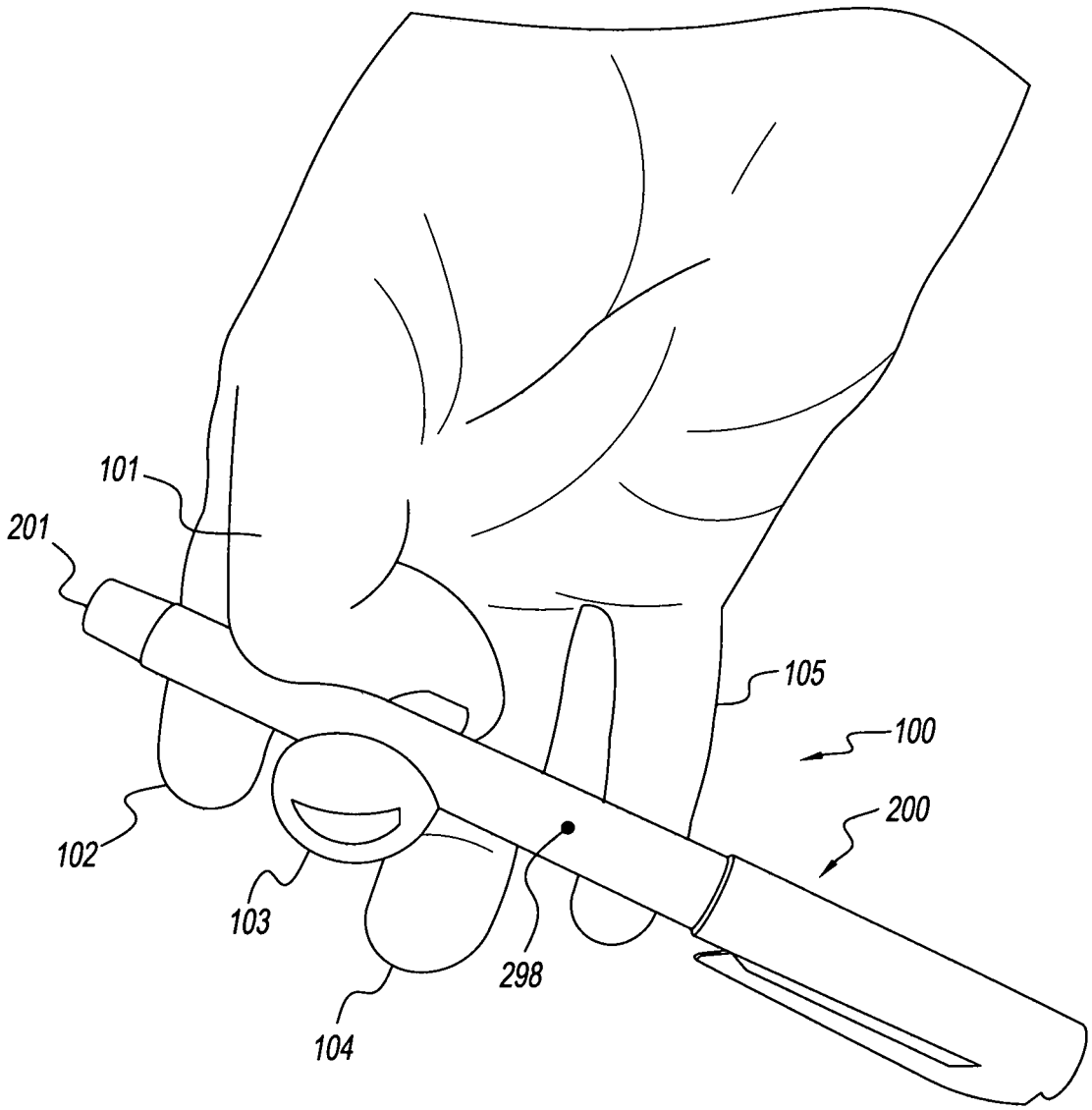

The maneuver of FIGS. 7A-7E performed with the toy (400) of the present invention is to be contrasted with what happens when that same maneuver is performed with a pen (200) or coin (110), i.e., objects where the profiles have no concave central region. For instance, when the same maneuver is performed with the pen (200), as is shown in FIGS. 8A-8B, the point of contact travels along the length of the pen (200). In FIG. 8A, the middle finger (103) presses the pen (200) against the right side of the thumb (101) at a point near the midpoint (298) of the pen (200). When the pen (200) has been guided by the middle finger (103) under the thumb (101) to the other side of the thumb (101) and then to the top of the thumb (101), as is shown in FIG. 8B, the point of contact has moved to be considerably closer to the end (201) of the pen (200). If this maneuver is continued, the point of contact will reach the end of the pen (200), and if the maneuver is continued even beyond that the pen (200) will fall. This issue is even more problematic with a coin since coins are much shorter than pens. A half-dollar size coin barely has enough size to perform the maneuver for a single rotation around the thumb, and certainly the coin does not have enough width to allow to two or more rotations to be performed.

Figure 9A:
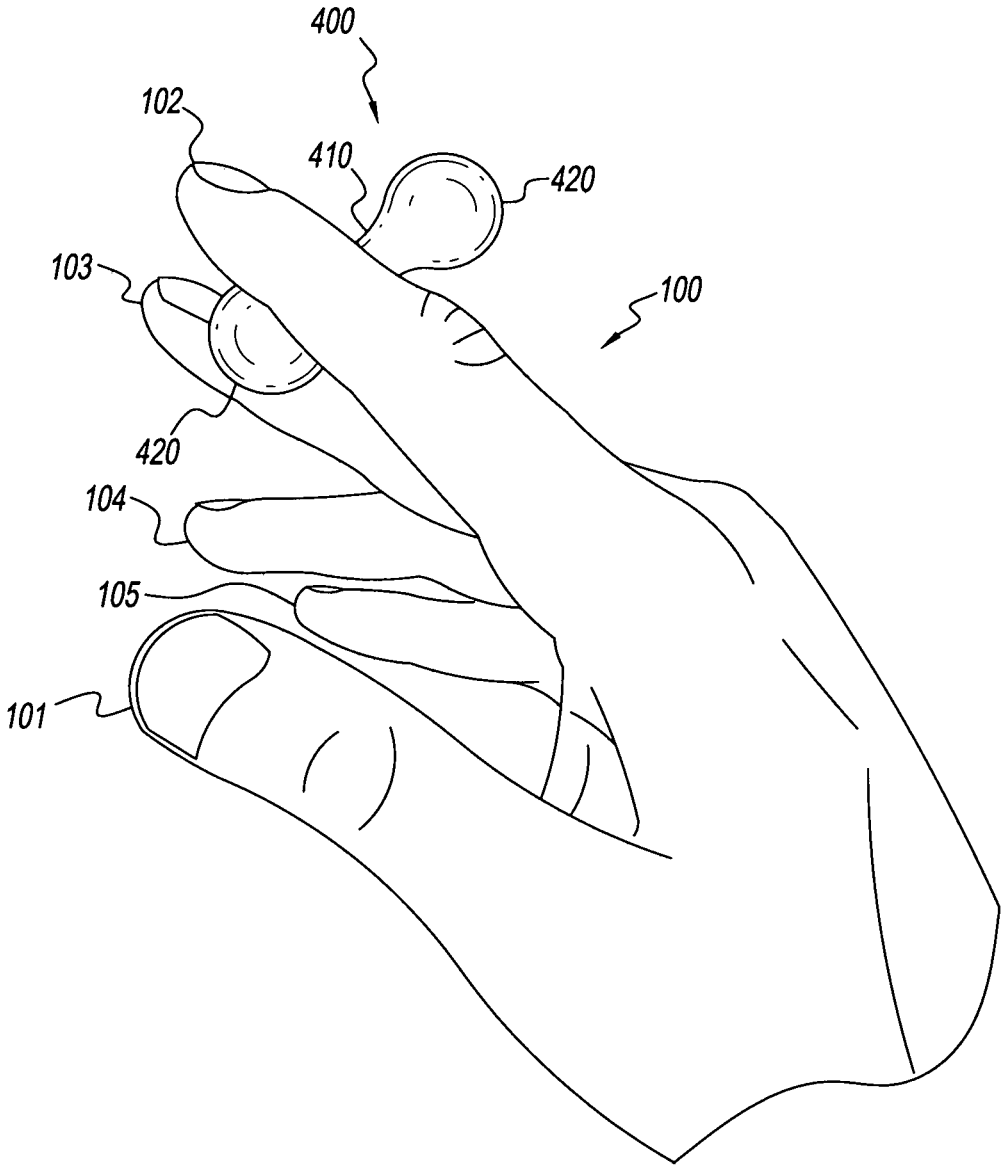
FIGS. 9A through 9C show a pivoting maneuver performed by holding a bell of the skill toy of the present invention.
Figure 9B:
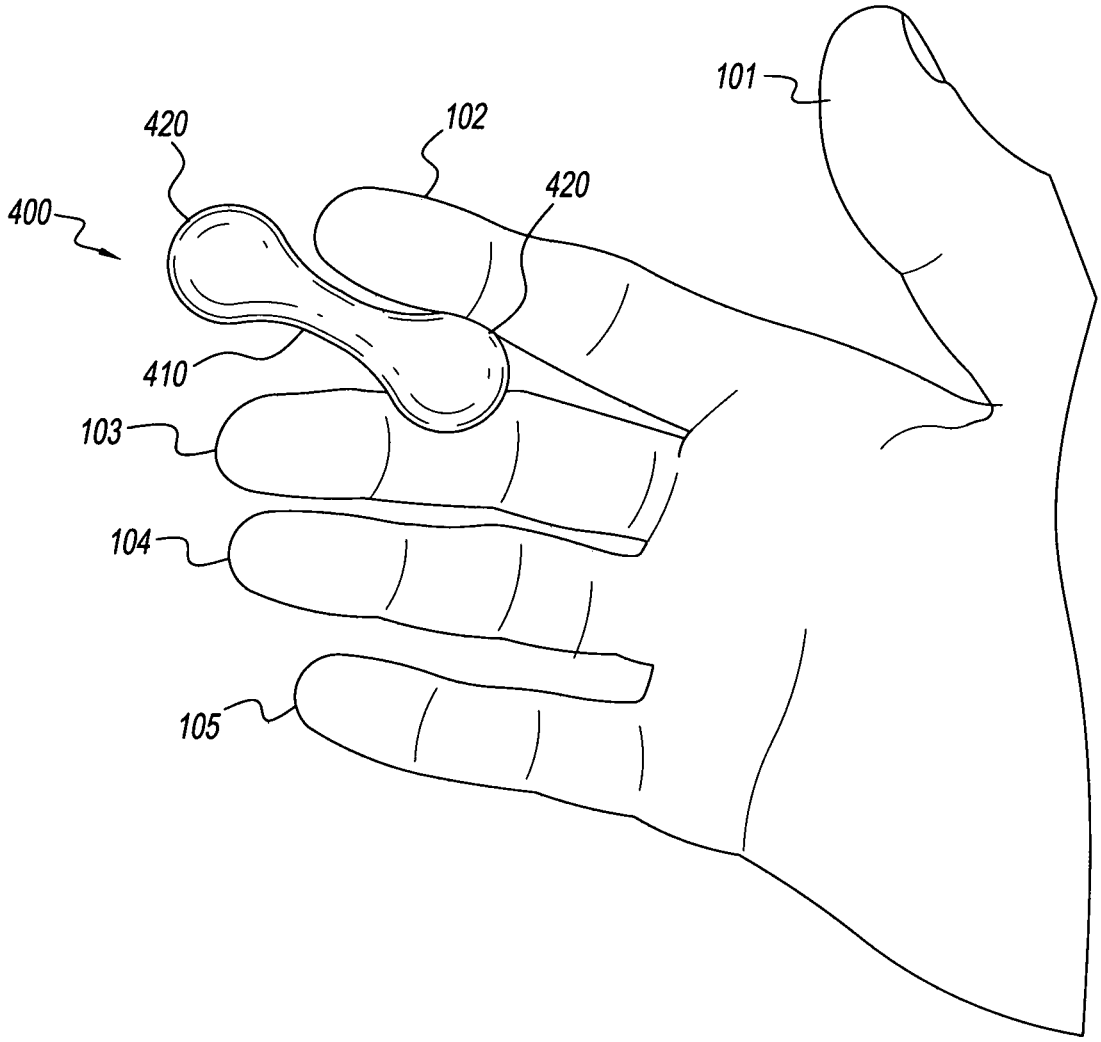
Figure 9C:
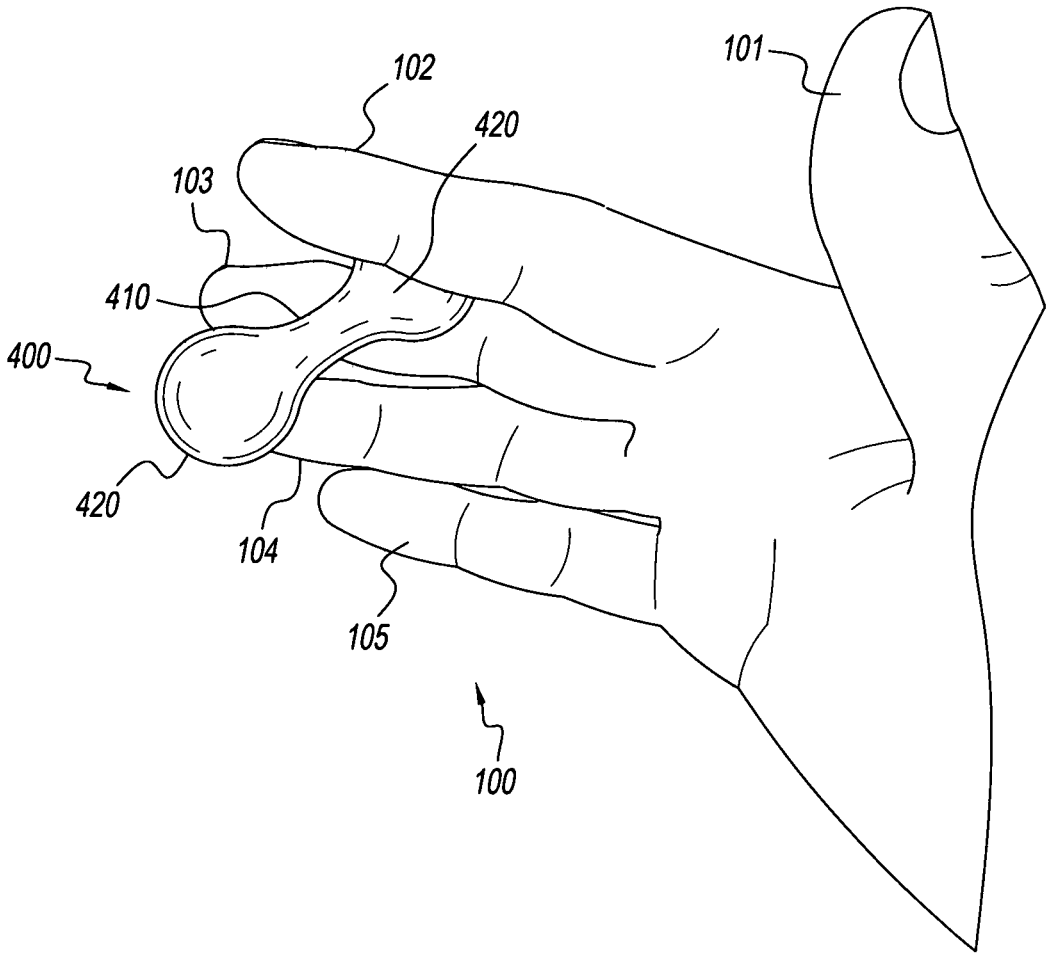
Figure 10A:
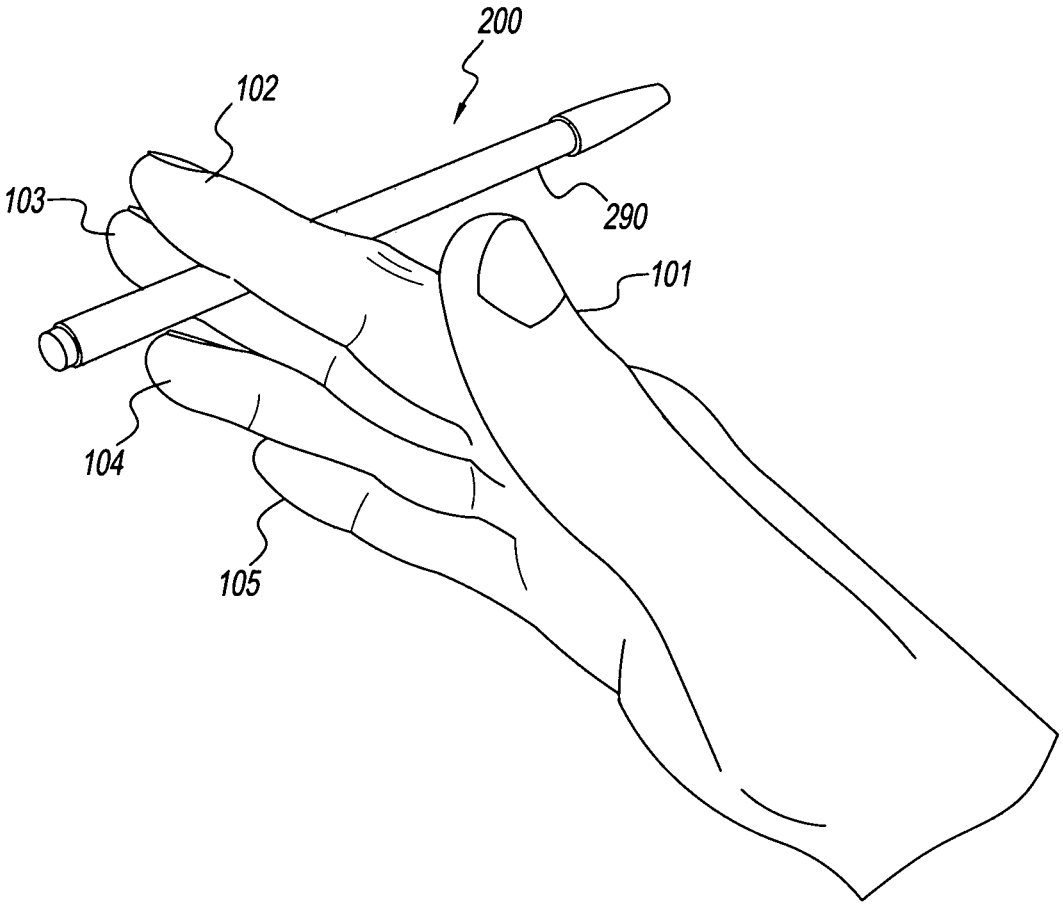
FIGS. 10A and 10B show an attempt at performing with a pen a pivoting maneuver equivalent to that performed with the toy of the present invention in FIGS. 9A through 9C.
Figure 10B:
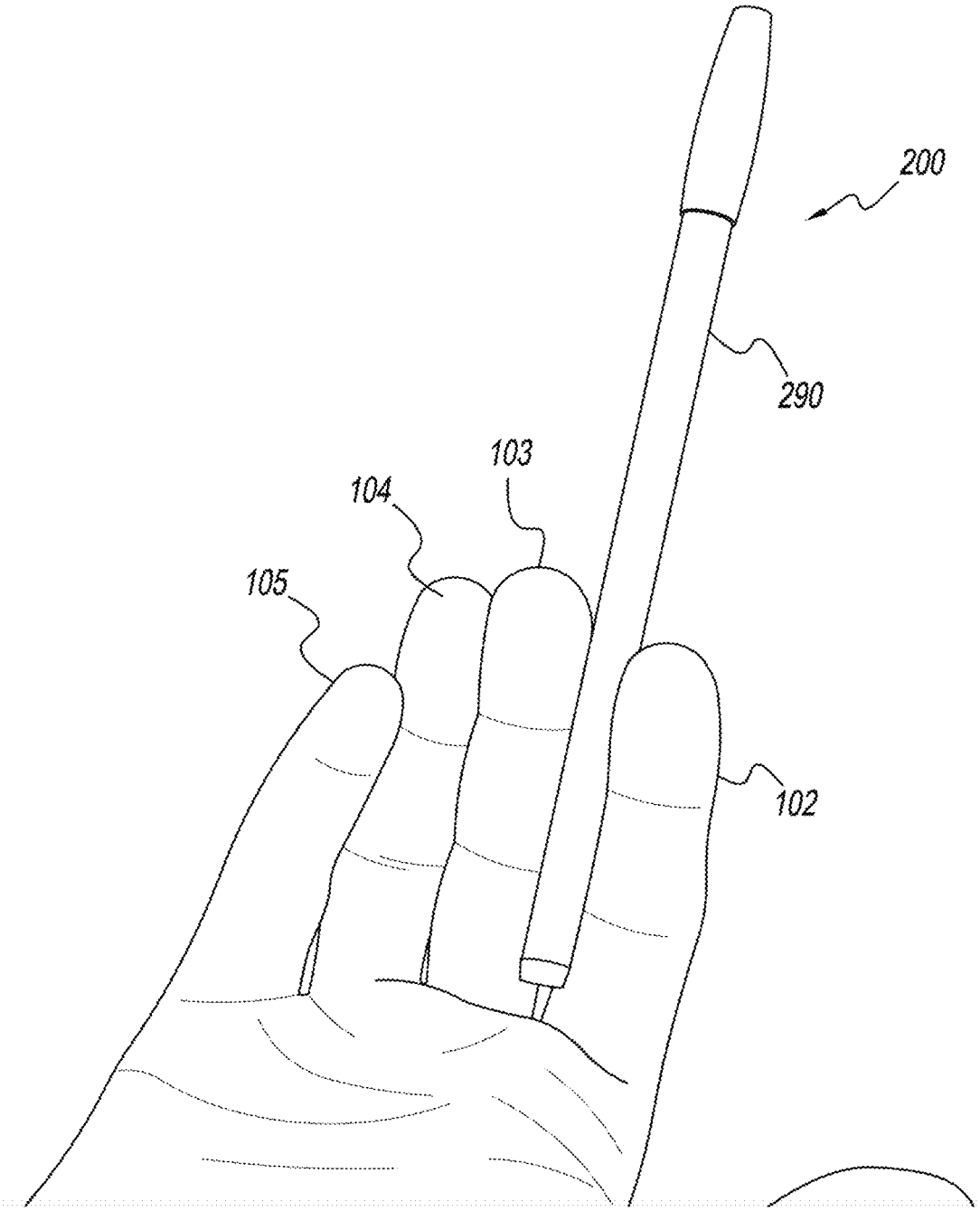

Another maneuver which can be performed with the toy (400) of the present invention but not with a pen (200) or coin (110) is shown in FIG. 9A-9C. In this maneuver a bell (420) is held between two fingers, and the toy (400) is pivoted around the held bell (420). In FIG. 9A the bell (420) is shown held between the index finger (102) and the middle finger (103) with the unheld bell (420) located to the back side of the palm. In FIG. 9B the unheld bell (420) has been swung forward and is now roughly in the plane of the fingers (100). And in FIG. 9C the unheld bell (420) has been swung farther forward and is now on the palm side of the fingers (100). This is to be contrasted with the attempt, as shown in FIGS. 10A and 10B, to perform the same maneuver with a pen (200). In FIG. 10A the pen (200) is shown held between the index finger (102) and the middle finger (103) with a longer portion (290) of the pen (200) located to the back side of the palm. In FIG. 10B the longer portion (290) of the pen (200) has been swung forward and is now roughly in the plane of the fingers (100). However, it should be noted that it is problematic to swing the longer portion (290) of the pen (200) farther forward than is shown in FIG. 10B to reach a position equivalent to that shown in FIG. 9C for the toy (400) of the present invention because the shorter portion (291) of the pen meets with considerable resistance with the bottom side of the index finger (102) and the top side of the middle finger (103). The difficulty in swinging the pen (200) farther than the position shown in FIG. 10B is compounded by the fact that there is no longer a well-defined axis of rotation since an extended length of the pen (200) is in contact with the index finger (102) and the middle finger (103).

Figure 11A:
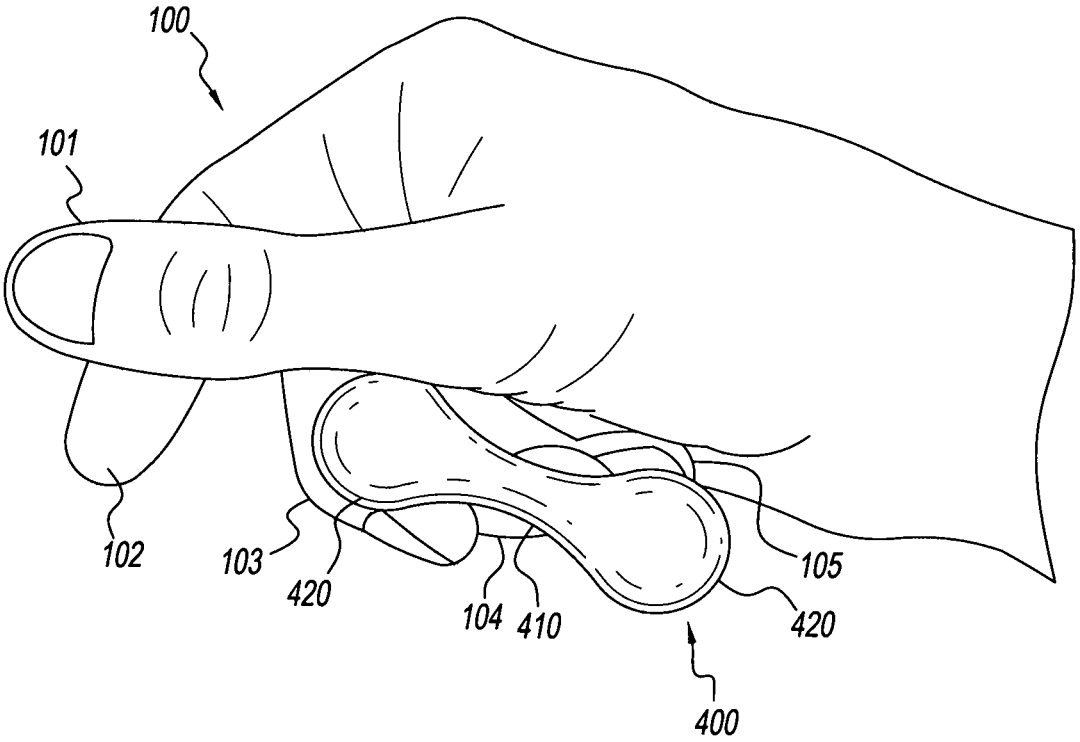
FIGS. 11A and 11B show another pivoting maneuver performed by holding a bell of the skill toy of the present invention.
Figure 11B:
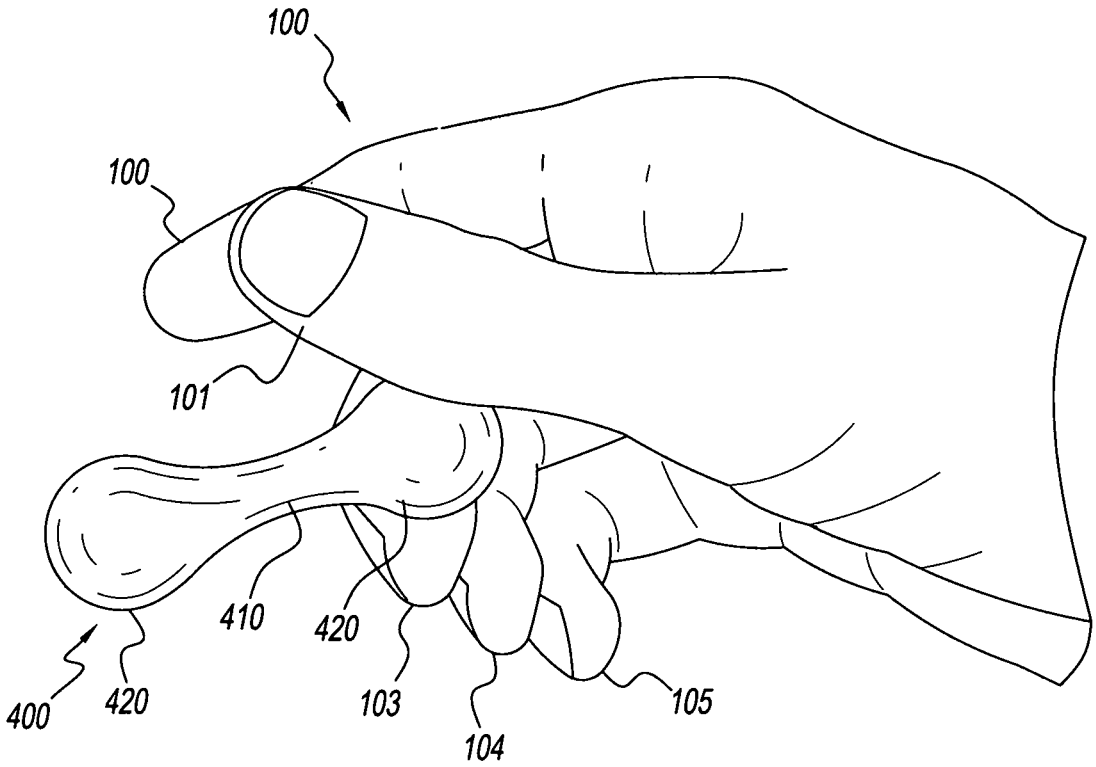

Another maneuver that is facilitated by the design of the toy (400) of the present invention is shown in FIGS. 11A and 11B where a bell (420) is held by contact between the base of the thumb (101) and the middle finger (103). Because the bell (420) is substantially spherical the orientation of the longitudinal axis is easy controlled by motions of the middle finger (103) relative to the thumb (101). This sort of maneuver cannot be readily performed with a pen (200) or a coin (110).

It should be understood that the above list of maneuvers enabled or facilitated by the shape of the toy (400) of the present invention is but a partial list. It has been shown that the design of the toy (400) enables many news tricks and also facilitates the performance of tricks that can be performed with other integrally-formed finger manipulation toys.

Thus, it will be seen that the improvements presented herein are consistent with the objects and advantages of the invention described above. While the above description contains many specificities, these should not be construed as limitations on the scope of the invention, but rather as exemplifications of preferred embodiments thereof. Many other variations are possible. For example: the toy may be made of a flexible material; the outer contour of the toy need not be smooth; the toy need not be cylindrically symmetrical; the toy need not have mirror symmetry about the midpoint; the outer ends of the bells need not be spherical; the top and bottom profiles of the shaft may be linear or V-shaped, or have some other shape differing from that described above; although the present specification describes finger movements used to manipulate the skill toy of the present invention, the toy may be manipulated by the palm, the wrist, or other body parts or even inanimate objects; etc. Accordingly, the scope of the invention should be determined not by the embodiments illustrated, but by the appended claims and their legal equivalents.

What is claimed is:

1. A finger manipulations skill toy comprising:

an elongated connecting shaft having a midpoint and a longitudinal axis, a first bell at a first end of said connecting shaft, said first bell having a first width in a direction orthogonal to said longitudinal axis, and a second bell at a second end of said connecting shaft, said second bell having a second width in said direction orthogonal to said longitudinal axis, exteriors of said connecting shaft, said first bell, and said second bell forming an exterior surface which has cylindrical symmetry about said longitudinal axis of said connecting shaft, said exterior surface having mirror symmetry about a plane through said midpoint of said connecting shaft where said longitudinal axis is a normal vector to said plane, said first width and said second width being equal, said first width and said second width being greater than a width of said connecting shaft at said midpoint, wherein the toy has a length along said longitudinal axis of between 40 mm and 80 mm, outer ends of said bells have a convex radius of curvature of between 7 mm and 15 mm, said elongated shaft has a width between 5 mm and 12 mm, and near a midpoint of said elongated shaft a profile of said toy has a concave radius of curvature of between 25 mm and 45 mm.

2. The finger manipulations skill toy of claim 1 wherein the toy is integrally-formed.

3. The finger manipulations skill toy of claim 1 wherein a profile of the toy, when viewed along an axis orthogonal to said longitudinal axis and through said midpoint, has convex portions at each end and concave portions in the middle.

4. The finger manipulations skill toy of claim 3 wherein said convex portions are substantially spherical.

5. The finger manipulations skill toy of claim 3 wherein there is a smooth transition between said convex portions and said concave portions.

6. The finger manipulations skill toy of claim 1 wherein the toy is made of a non-flexible material.

7. The finger manipulations skill toy of claim 1 wherein the toy has a length along said longitudinal axis of between 45 mm and 75 mm, outer ends of said bells have a convex radius of curvature of between 8 mm and 13 mm, said elongated shaft has a width between 6 mm and 10 mm, and near a midpoint of said elongated shaft a profile of said toy has a concave radius of curvature of between 28 mm and 40 mm.

8. The finger manipulations skill toy of claim 1 wherein the toy has a length along said longitudinal axis of between 50 mm and 70 mm, outer ends of said bells have a convex radius of curvature of between 9 mm and 12 mm, said elongated shaft has a width between 7 mm and 9 mm, and near a midpoint of said elongated shaft a profile of said toy has a concave radius of curvature of between 32 mm and 37 mm.

9. The finger manipulations skill toy of claim 1 wherein the toy has a length along said longitudinal axis of between 55 mm and 65 mm, outer ends of said bells have a convex radius of curvature of between 9 mm and 12 mm, said elongated shaft has a width between 7 mm and 9 mm, and near a midpoint of said elongated shaft a profile of said toy has a concave radius of curvature of between 32 mm and 37 mm.

* * * * *